US008382554B2

(12) United States Patent
Kim et al.

(10) Patent No.: US 8,382,554 B2
(45) Date of Patent: Feb. 26, 2013

(54) SUBSTRATE POLISHING APPARATUS AND METHOD OF POLISHING SUBSTRATE USING THE SAME

(75) Inventors: Seong-soo Kim, Chungcheongnam-do (KR); Sehoon Oh, Seoul (KR)

(73) Assignee: Semes Co. Ltd., Chungcheongnam-Do (KR)

( * ) Notice: Subject to any disclaimer, the term of this patent is extended or adjusted under 35 U.S.C. 154(b) by 592 days.

(21) Appl. No.: 12/624,967

(22) Filed: Nov. 24, 2009

(65) Prior Publication Data

US 2010/0136884 A1 Jun. 3, 2010

(30) Foreign Application Priority Data

Nov. 28, 2008 (KR) ..... 10-2008-0119920

(51) Int. Cl.
*B24B 49/00* (2012.01)

(52) U.S. Cl. ..... 451/8; 451/11; 451/41; 451/288

(58) Field of Classification Search ..... 451/5, 8, 451/11, 41, 285–290
See application file for complete search history.

(56) References Cited

U.S. PATENT DOCUMENTS

| | | | | |
|---|---|---|---|---|
| 4,606,151 | A * | 8/1986 | Heynacher | 451/42 |
| 4,850,152 | A * | 7/1989 | Heynacher et al. | 451/5 |
| 6,106,369 | A | 8/2000 | Konishi et al. | |
| 6,159,080 | A | 12/2000 | Talieh | |
| 6,220,945 | B1 * | 4/2001 | Hirokawa et al. | 451/287 |
| 6,241,578 | B1 * | 6/2001 | Togawa et al. | 451/5 |
| 6,488,569 | B1 * | 12/2002 | Wang et al. | 451/8 |
| 6,623,329 | B1 * | 9/2003 | Moore | 451/5 |
| 6,840,840 | B2 * | 1/2005 | Moore | 451/5 |
| 8,113,918 | B2 * | 2/2012 | Koo et al. | 451/67 |
| 2002/0028629 | A1 * | 3/2002 | Moore | 451/6 |
| 2002/0037681 | A1 * | 3/2002 | Gitis et al. | 451/5 |
| 2004/0009637 | A1 | 1/2004 | Ishikawa | |
| 2005/0221736 | A1 * | 10/2005 | Hsin et al. | 451/357 |
| 2006/0046619 | A1 * | 3/2006 | Lin et al. | 451/8 |
| 2007/0049172 | A1 * | 3/2007 | Blalock | 451/8 |
| 2011/0021115 | A1 * | 1/2011 | Oh et al. | 451/9 |

FOREIGN PATENT DOCUMENTS

| | | | |
|---|---|---|---|
| JP | 1988-132172 | A | 8/1988 |
| JP | 09-168969 | A | 6/1997 |
| JP | 09-254024 | A | 9/1997 |
| JP | H09-254024 | A | 9/1997 |
| JP | 10-044029 | A | 2/1998 |
| JP | 10-113862 | A | 5/1998 |
| JP | 2000-233364 | A | 8/2000 |
| JP | 2001160543 | A | 6/2001 |
| JP | 2003-188131 | A | 7/2003 |

(Continued)

*Primary Examiner* — Maurina Rachuba
(74) *Attorney, Agent, or Firm* — Carter, DeLuca, Farrell & Schmidt LLP

(57) ABSTRACT

Provided are a substrate polishing apparatus and a method of polishing a substrate using the same. The substrate polishing apparatus includes a substrate supporting member, a polishing unit, and a control unit. The substrate is seated on the rotatable substrate supporting member. The polishing unit includes a rotatable and swingable polishing pad to polish a top surface of the substrate. The control unit controls the substrate supporting member and the polishing unit during a polishing process to adjust a value of a polishing variable adjusting a polishing amount of the substrate according to a horizontal position of the polishing pad with respect to the substrate. Therefore, the substrate polishing apparatus may locally adjust the polishing amount of the substrate to improve polishing uniformity and product yield.

14 Claims, 18 Drawing Sheets

FOREIGN PATENT DOCUMENTS

| | | | |
|---|---|---|---|
| JP | 2006-346821 | A | 12/2006 |
| JP | 2007-318041 | A | 12/2007 |
| KR | 10-0171491 | B1 | 10/1998 |
| KR | 101999014121 | A | 2/1999 |
| KR | 20050025815 | A | 3/2005 |

* cited by examiner

SUBSTRATE POLISHING APPARATUS AND METHOD OF POLISHING SUBSTRATE USING THE SAME

CROSS-REFERENCE TO RELATED APPLICATIONS

This U.S. non-provisional patent application claims priority under 35 U.S.C. §119 of Korean Patent Application No. 10-2008-0119920, filed on Nov. 28, 2008, the entire contents of which are hereby incorporated by reference.

BACKGROUND

The present disclosure herein relates to an apparatus and method of manufacturing a semiconductor, and more particularly, to a substrate processing apparatus and method for polishing and cleaning a semiconductor substrate in a single wafer processing manner.

In a general, semiconductor device manufacturing process a plurality of unit processes such as a deposition process, a photolithography process, and an etch process should be repeatedly performed to form and stack a thin film. These processes are repeated until desired predetermined circuit patterns are formed on a wafer. After the circuit patterns are formed, a surface of the wafer is uneven. As semiconductor devices are now highly integrated and also multilayered in structure, the number of curvatures on a surface of a wafer and a height difference between the curvatures increase. As a result, due to the non-planarization of the surface of the wafer, defocus may occur in a photolithography process. Thus, to realize the planarization of the surface of the wafer, the wafer surface should be periodically polished.

Various surface planarization techniques have been developed for planarizing the surface of the wafer. Among these, a chemical mechanical polishing (CMP) technique is widely used because wide surfaces as well as narrow surfaces may be planarized with good flatness by using the CMP technique. A CMP apparatus is used to polish the surface of the wafer coated with tungsten or an oxide by using mechanical friction and chemical abrasives, and very fine polishing is possible using the CMP apparatus.

Also, as semiconductor devices are highly integrated and offer high density and high performance, circuit patterns of the semiconductor devices become minute. Thus, pollutants such as particles, organic contaminants, and metal impurities, which remain on a surface of the substrate, significantly affect device characteristics and product yield. Thus, a cleaning process for removing the various pollutants attached to the surface of the substrate is becoming very important in a semiconductor manufacturing process. Therefore, the substrate cleaning process is performed before and after each unit process.

SUMMARY OF THE INVENTIVE CONCEPT

Embodiments of the inventive concept provide a substrate polishing apparatus that may improve polishing efficiency Embodiments of the inventive concept also provide a method of polishing a substrate using the above-described substrate polishing apparatus.

Embodiments of the inventive concept provide substrate polishing apparatuses including: a substrate supporting member, a polishing unit, and a control unit.

The substrate may be seated on the rotatable substrate supporting member. The polishing unit may include a rotatable and swingable polishing pad to polish a top surface of the substrate. The control unit may control the substrate supporting member and the polishing unit during a polishing process to adjust a value of a polishing variable adjusting a polishing amount of the substrate according to a horizontal position of the polishing pad with respect to the substrate.

In other embodiments of the inventive concept, methods of polishing a substrate include the following processes. The substrate may be seated on a substrate supporting member. A polishing pad may be disposed on a top surface of the substrate. The polishing pad may be rotated and swung while the polishing pad compresses the substrate to polish the substrate. During the polishing process of the substrate, a value of a polishing variable adjusting a polishing amount of the substrate may be adjusted according to a horizontal position of the polishing pad with respect to the substrate to locally adjust the polishing amount of the substrate.

BRIEF DESCRIPTION OF THE DRAWINGS

The accompanying drawings are included to provide a further understanding of the inventive concept, and are incorporated in and constitute a part of this specification. The drawings illustrate exemplary embodiments of the inventive concept and, together with the description, serve to explain principles of the inventive concept. In the figures.

DETAILED DESCRIPTION OF THE EMBODIMENTS

Preferred embodiments of the inventive concept will be described below in more detail with reference to the accompanying drawings. The inventive concept may, however, be embodied in different forms and should not be construed as limited to the embodiments set forth herein. Rather, these embodiments are provided so that this disclosure will be thorough and complete, and will fully convey the scope of the inventive concept to those skilled in the art. For example, although a wafer is used as a semiconductor substrate, technical scope and spirit of the inventive concept is not limited thereto.

Figure 1:
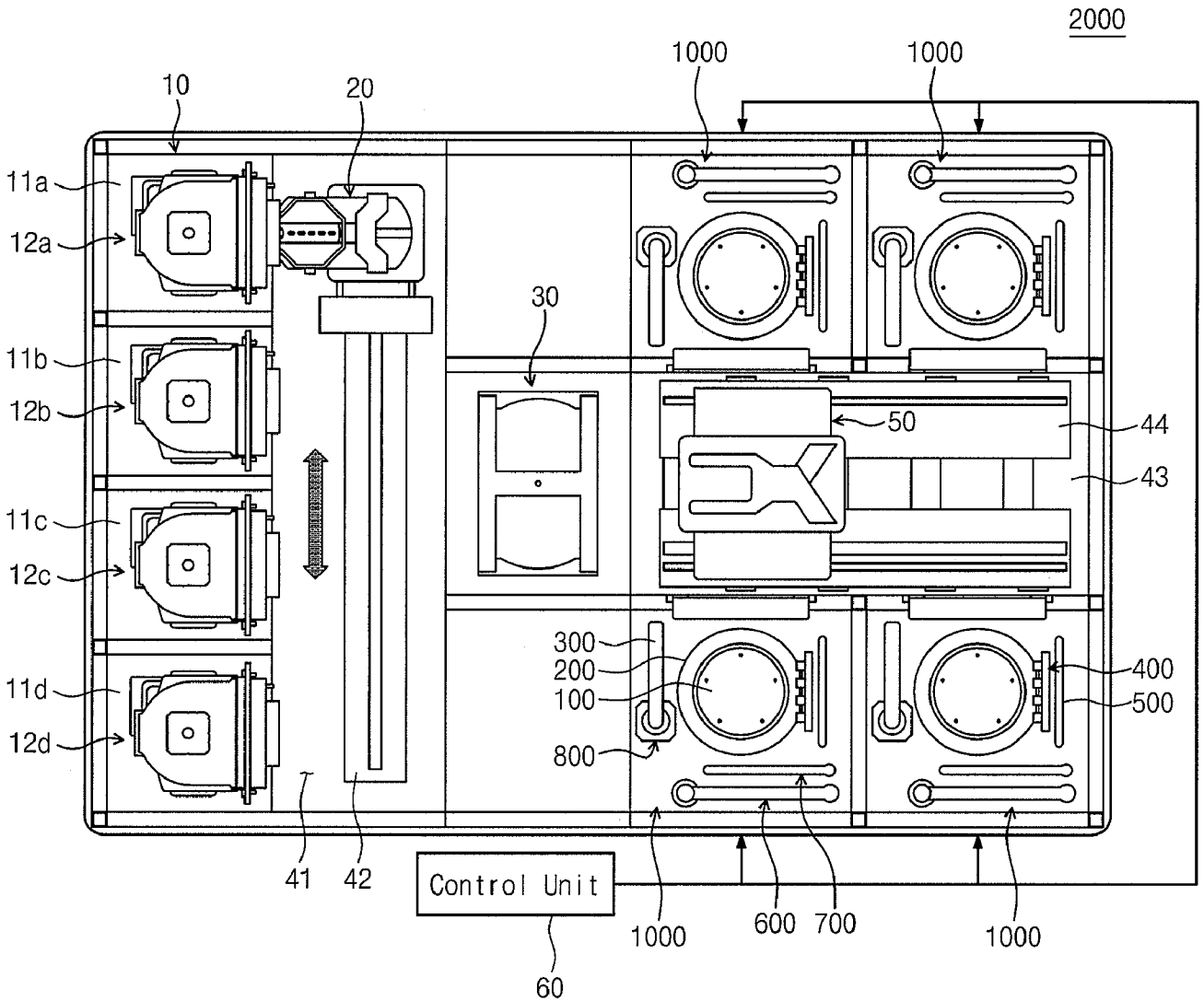
FIG. 1 is a schematic view of a single wafer type polishing system according to an embodiment of the inventive concept.
Figure 2:
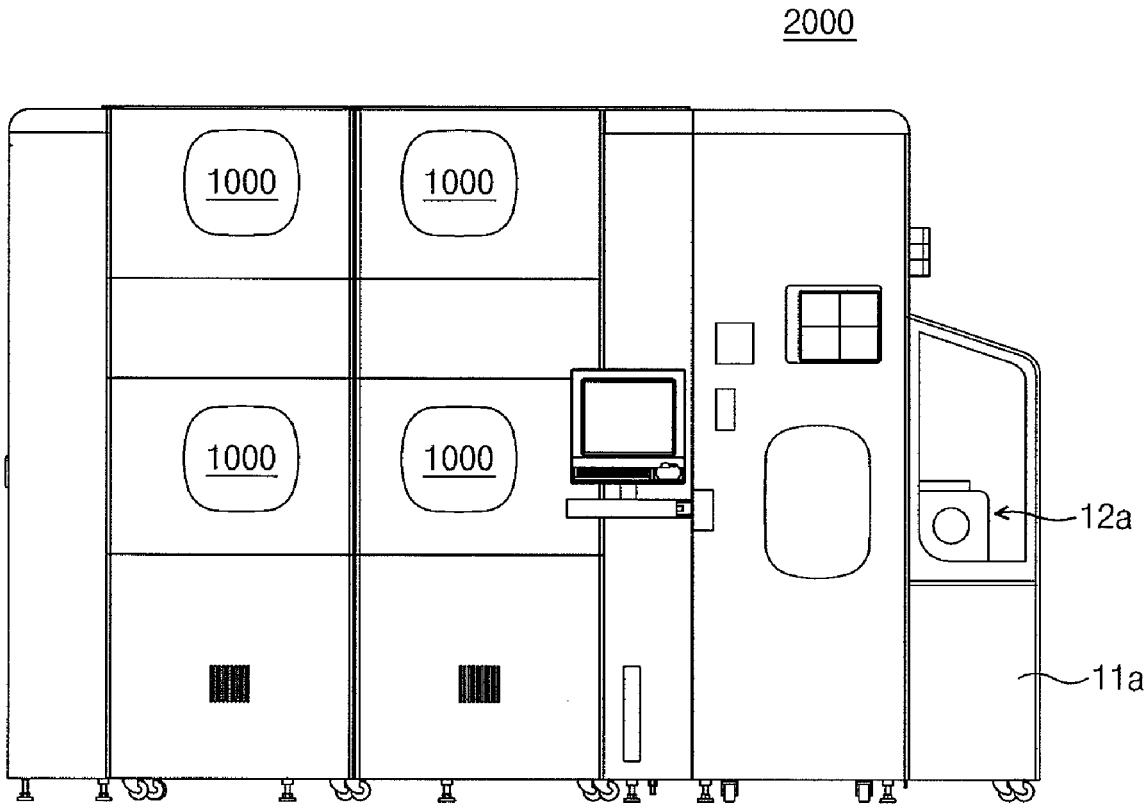
FIG. 2 is a side sectional view illustrating the single wafer type polishing system of FIG. 1.

FIG. 1 is a schematic view of a single wafer type polishing system according to an embodiment of the inventive concept, and FIG. 2 is a side sectional view illustrating the single wafer type polishing system of FIG. 1.

Referring to FIGS. 1 and 2, a substrate processing system 2000 may include a loading/unloading unit 10, an index robot 20, a buffer unit 30, a main transfer robot 50, a plurality of substrate polishing units 1000, and a control unit 60.

The loading/unloading unit 10 includes a plurality of load ports 11*a*, 11*b*, 11*c*, and 11*d*. Although the loading/unloading unit 10 includes four load ports 11*a*, 11*b*, 11*c*, and 11*d* in this embodiment, the number of the load ports 11*a*, 11*b*, 11*c*, and 11*d* may increase and decrease according to process efficiency and foot print conditions of the substrate processing system 2000.

Front open unified pods (FOUPs) 12*a*, 12*b*, 12*c*, and 12*d* in which wafers are received are seated on the load ports 11*a*, 11*b*, 11*c*, and 11*d*, respectively. A plurality of slots for receiving the wafers in a horizontal direction with respect to a ground surface is disposed in the respective FOUPs 12*a*, 12*b*, 12*c*, and 12*d*. The FOUPs 12*a*, 12*b*, 12*c*, and 12*d* receive wafers that have been processed in the respective substrate polishing units 1000 or wafers that will be loaded into the respective substrate polishing units 1000. Hereinafter, for convenience of description, the wafers that have been processed in the respective substrate polishing units 1000 are referred to as processed wafers, and the wafers that are not processed yet are referred to as primitive wafers.

A first transfer path 41 is disposed between the loading/unloading unit 10 and the buffer unit 30. A first transfer rail 42 is disposed in the first transfer path 41. The index robot 20 is disposed on the first transfer rail 42. The index robot 20 moves along the first transfer rail 42 to transfer the wafers between the loading/unloading unit 10 and the buffer unit 30. That is, the index robot 20 takes out at least one primitive wafer from FOUPs 12*a*, 12*b*, 12*c*, and 12*d* seated on the loading/unloading unit 10 to load the wafer on the buffer unit 30. Also, the index robot 20 takes out at least one processed wafer from the buffer unit 30 to load the wafer on the FOUPs 12*a*, 12*b*, 12*c*, and 12*d* seated on the loading/unloading unit 10.

The buffer unit 30 is disposed at a side of the first transfer path 41. The buffer unit 30 receives the primitive wafers transferred by the index robot 20 and the wafers processed in the substrate polishing units 1000.

The main transfer robot 50 is disposed in a second transfer path 43. A second transfer rail 44 is disposed in the second transfer path 43. The main transfer robot 50 is disposed on the second transfer rail 44. The main transfer robot 50 moves along the second transfer rail 44 to transfer the wafers between the buffer unit 30 and the substrate polishing units 1000. That is, the main transfer robot 50 takes out at least one primitive wafer from the buffer unit to provide the wafer to the substrate polishing units 1000. Also, the main transfer robot 50 takes out at least one processed wafer from the substrate polishing units 100 to load the processed wafer on the buffer unit 30.

The substrate polishing units 1000 are disposed at both sides of the second transfer path 43. The respective substrate polishing units 1000 polish and clean the primitive wafer to manufacture the processed wafer. In the substrate polishing units 1000, at least two or more substrate polishing units are symmetrically disposed centered about the second transfer path 43 to face each other. In an example of the inventive concept, when viewed in plan, although two pairs of substrate polishing units are disposed at both sides of the second transfer path 43 and parallelly disposed along the second transfer path 43, respectively, the number of the substrate polishing units disposed at both sides of the second transfer path 43 may increase and decrease according to the process efficiency and the foot print conditions of the substrate processing system 2000.

The substrate polishing units 1000 may be disposed into a multilevel structure. In an example of the inventive concept, the substrate polishing units 1000 are stacked into two layers, each level including two substrate polishing units 1000.

That is, eight substrate polishing units are provided. With two levels of two substrate polishing units each is disposed respectively at either side of the second transfer path 43. The number of levels on which the substrate polishing units are stacked, the number of substrate polishing units disposed on each level, and the number of rows along which the substrate polishing units are sequentially and parallelly disposed may increase and decrease according to the process efficiency and the foot print conditions of the substrate processing system 2000. When the number of the rows along which the substrate polishing units are parallelly disposed increases, the number of the second transfer path 43 and the main transfer robot 50 increases. Also, when the number of the levels on which the substrate polishing units increases, the number of the main transfer robot 50 may increase.

As described above, since the substrate polishing units 1000 are disposed into a plurality of levels and a plurality of rows, a plurality of wafers may be polished and cleaned in the substrate processing system 2000 at the same time. Thus, the process efficiency and productivity of the substrate processing system 2000 may be improved, and also, the foot print may be reduced.

Each of the substrate polishing units 1000 is connected to the control unit 60 to polish and clean the primitive wafer under the control of the control unit 60. That is, the control unit 60 controls the substrate polishing unit 1000 to locally adjust a polishing amount of the primitive wafer polished by the substrate polishing unit 1000, thereby improving polishing uniformity of the substrate polishing unit 1000. A process of controlling the polishing amount of the substrate polishing unit 100 through the control unit 60 will be described in detail with reference to FIGS. 15 through 18.

Hereinafter, a configuration of the substrate polishing unit 1000 will be described in detail with reference to accompanying drawings.

Figure 3:
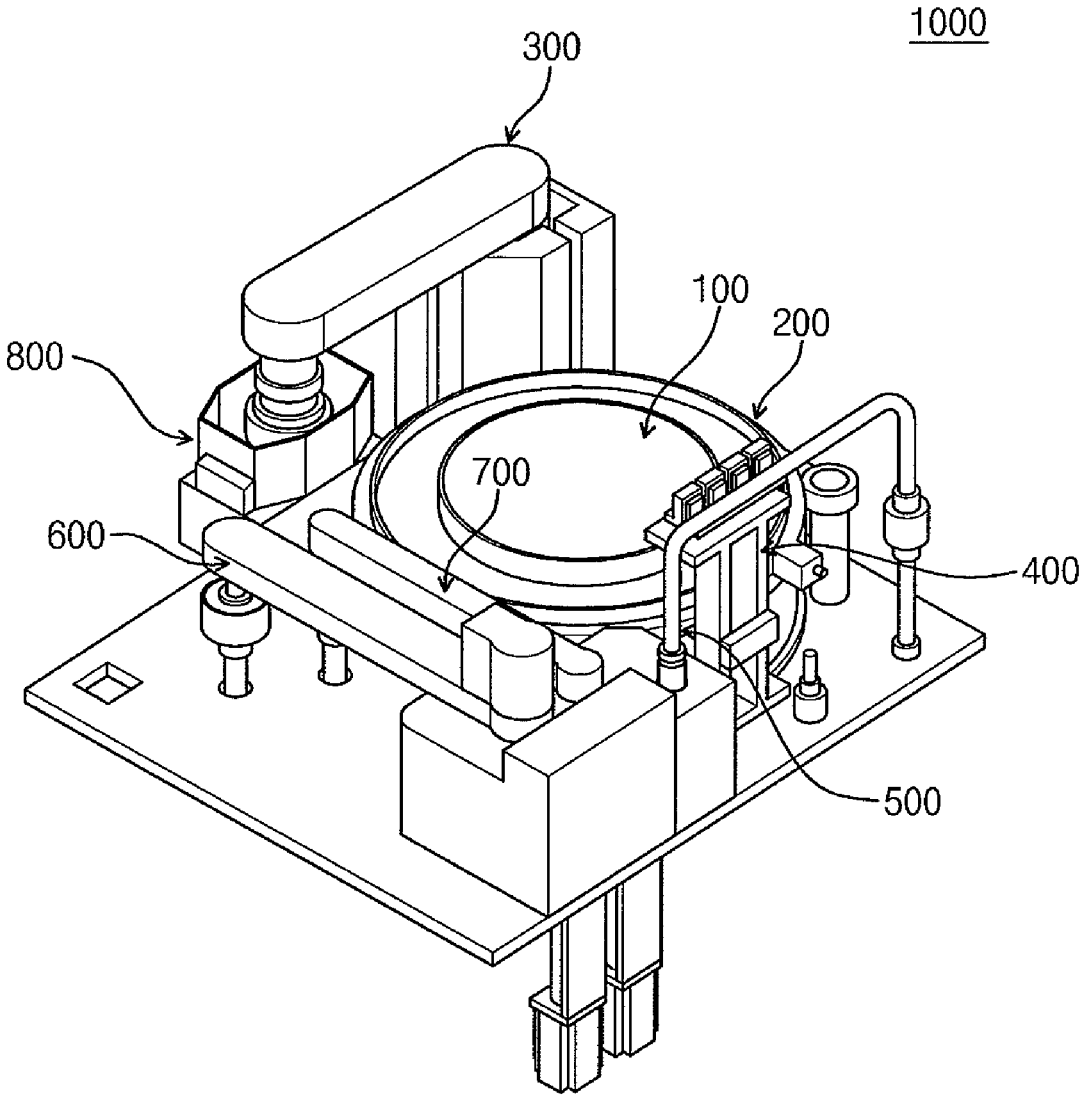
FIG. 3 is a perspective view illustrating a substrate polishing unit of FIG. 1.
Figure 4:
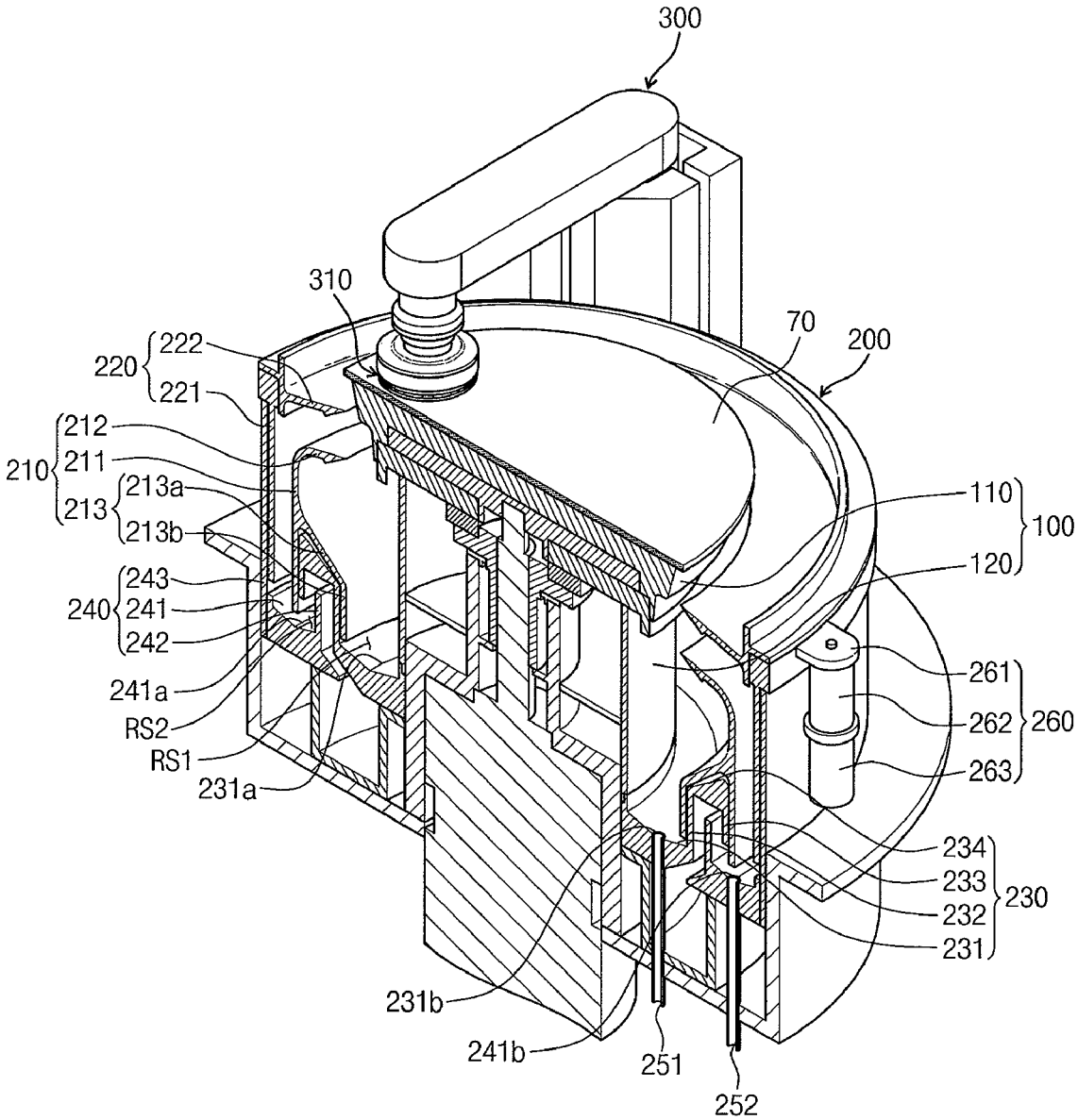
FIG. 4 is a partially sectional perspective view of a substrate supporting unit and a process bowl of FIG. 3.

FIG. 3 is a perspective view illustrating a substrate polishing unit of FIG. 1, and FIG. 4 is a partially sectional perspective view of a substrate supporting unit and a process bowl of FIG. 3.

Referring to FIGS. 1, 3, and 4, in the substrate processing system 2000, a polishing process in which a top surface of a wafer 70 is polished and a cleaning process in which a surface of the wafer 70 is cleaned after the polishing process is performed may be sequentially performed within the each of the substrate polishing unit 1000.

Particularly, the substrate polishing unit 1000 may include a substrate supporting unit 100, a bowl unit 200, a polishing unit 300, first and second process fluid supply units 400 and 500, a brush unit 600, an aerosol unit 700, and a pad conditioning unit 800.

A wafer 70 transferred from the main transfer robot 50 is seated on the substrate supporting unit 100. The substrate supporting unit 100 supports and fixes the wafer 70 during the polishing process and the cleaning process of the wafer 70. The substrate supporting unit 100 may include a spin head 110 on which the wafer 70 is seated and a supporting part 120 supporting the spin head 110. The spin head 110 has a substantially circular shape when viewed in plan, and a width thereof gradually decreases from a top surface thereof to a bottom surface. In an example of the inventive concept, the top surface of the spin head 110 supporting the wafer 70 has a size less than that of the wafer 70. That is, the top surface of the spin head 110 has a diameter less than that of the wafer 70. Thus, when viewed from side, an end of the wafer 70 seated on the spin head 110 protrudes outwardly from a top end of the spin head 110.

The supporting part 120 is disposed below the spin head 110. The supporting part 120 has a substantially approximately cylindrical shape. The supporting part 120 is coupled to the spin head 110 to rotate the spin head 110 during the polishing and cleaning processes.

The substrate supporting unit 100 is received into the bowl unit 200. The bowl unit 200 may include first and second process bowls 210 and 220, first and second recovery vats 230 and 240, first and second recovery tubes 251 and 252, and an ascending/descending member 260.

Particularly, the first and second process bowls 210 and 220 surround the substrate supporting unit 100 to provide a space in which the polishing and cleaning processes are performed on the wafer 70. Each of the first and second process bowls 210 and 220 has an opened upper portion through which the spin head 110 is exposed. Although each of the first and second process bowls 210 and 220 has a circular ring shape in this embodiment, the inventive concept is not limited thereto. For example, the each of the first and second process bowls 210 and 220 may have various shapes.

Particularly, the first process bowl 210 may include a sidewall 211, a top plate 212, and a guide part 213. The sidewall 211 may have an approximately circular ring shape to surround the substrate supporting unit 100.

An upper end of the sidewall 211 is connected to the top plate 212. The top plate 212 extends from the sidewall 211 and has a surface inclined upwardly away from the sidewall 211. The top plate 212 has an approximately circular ring shape. When viewed in plan, the top plate 212 is spaced from the spin head 110 to surround the spin head 110.

The guide part 213 includes first and second guide walls 213*a* and 213*b*. The first guide wall 213*a* protrudes from an inner wall of the sidewall 211 to face the top plate 212. Also, the first guide wall 213*a* has a surface inclined downwardly away from the sidewall 211. The first guide wall 213*a* may have a circular ring shape. The second guide wall 213*b* vertically extends downward from the first guide wall 213*a* to face the sidewall 211. The second guide wall 213*b* may have a circular ring shape. The guide part 213 guides a flow of a process liquid scattered onto inner surfaces of the sidewall 211 and the top plate 212 of the first process bowl 210 during the polishing process of the wafer 70 toward the first recovery vat 230.

The second process bowl 220 is disposed outside the first process bowl 210. The second process bowl 220 surrounds the first process bowl 210. Thus, the second process bowl 220 has a size greater than that of the first process bowl 210.

Particularly, the second process bowl 220 may include a sidewall 221 and a top plate 222. The sidewall may have an approximately circular ring shape to surround the sidewall 211 of the first process bowl 210. The sidewall 221 is disposed spaced from the sidewall 211 of the first process bowl 210 and connected to the first process bowl 210.

An upper end of the sidewall 221 is connected to the top plate 222. The top plate 222 extends from the sidewall 221 and has a surface inclined upwardly away from the sidewall 221. The top plate 222 has an approximately circular ring shape. When viewed in plan, the top plate 222 is spaced from the spin head 110 to surround the spin head 110. The top plate 222 is disposed above the top plate 211 of the first process bowl 210. Also, the top plate 222 faces the top plate 211 of the first process bowl 210 and is spaced from the top plate 211 of the first process bowl 210.

The first and second recovery vats 230 and 240 are disposed below the first and second process bowls 210 and 220 to recover the process liquids used for the polishing and cleaning processes. Each of the first and second recovery vats 230 and 240 has an approximately circular ring shape with an opened upper portion. Although each of the first and second recovery vats 230 and 240 has the circular ring shape in this embodiment, the inventive concept is not limited thereto. For example, each of the first and second recovery vats 230 and 240 may have various shapes.

The first recovery vat 230 is disposed below the first process bowl 210 to recover the process liquid used for the polishing process. The second recovery vat 240 is disposed below the second process bowl 220 to recover the process liquid used for the cleaning process.

Particularly, the first recovery vat 230 may include a bottom plate 231, a first sidewall 232, a second sidewall 233, and a connection part 234. The bottom plate 231 has an approximately circular ring shape to surround the supporting part 120. In an example of the inventive concept, the bottom plate 231 has a 'V' shape in section to easily discharge the process liquid recovered into the first recovery vat 230. Thus, a recovery flow path 231*a* having a ring shape is disposed in the bottom plate 231 to easily discharge and recover the process liquid.

The first sidewall 232 vertically extends from the bottom plate 231 to provide a first recovery space RS1 for recovering the process liquid. The second sidewall 233 is spaced from the first sidewall 232 to face the first sidewall 232. The connection part 234 is connected to the upper end of the first sidewall 232 and the upper end of the second sidewall 233. The connection part 234 has a surface inclined upwardly from the first sidewall 232 toward the second sidewall 233. The connection part 234 guides the process liquid dropped outside the first recovery space RS1 toward the first recovery space RS1 to introduce the process liquid into the first recovery space RS1.

The second recovery vat 240 is disposed outside the first recovery vat 230. The second recovery vat 240 surrounds the first recovery vat 230 and is spaced from the first recovery vat 230. Particularly, the second recovery vat 240 may include a bottom plate 241, a first sidewall 242, and a second sidewall 243. The bottom plate 241 has an approximately circular ring shape to surround the bottom plate 231 of the first recovery vat 230. In an example of the inventive concept, the bottom plate 241 has a 'V' shape in section to easily discharge the process liquid recovered into the second recovery vat 240. Thus, a recovery flow path 241*a* having a ring shape is disposed in the bottom plate 241 to easily discharge and recover the process liquid.

The first and second sidewalls 242 and 243 vertically extend from the bottom plate 241 to provide a second recovery space RS2 for recovering the process liquid. Each of the first and second sidewalls 242 and 243 has a circular ring shape. The first sidewall 242 is disposed between the first and second sidewalls 232 and 233 of the first recovery vat 230 to surround the first sidewall 232 of the first recovery vat 230. The second sidewall 243 of the second recovery vat 240 faces the first sidewall 242 with the bottom plate 242 therebetween to surround the first sidewall 242. The second sidewall 243 of the second recovery vat 240 surrounds the second sidewall 233 of the first recovery vat 230, and an upper end thereof is disposed outside the sidewall 221 of the second process bowl 220.

When the polishing and cleaning processes are performed on the wafer 70, vertical positions between the spin head 110 and the first and second process bowls 210 and 220 are changed according to each process. Thus, the first and second recovery vats 230 and 240 respectively recover process liquids used for processes different from each other.

Particularly, when the polishing process is performed, the spin head 110 is disposed within the first process bowl 210 to perform the polishing process on the wafer 70 within the first process bowl 210. During the polishing process, the wafer 70 is rotated by the rotation of the spin head 110. Thus, during the polishing process, a process liquid sprayed onto the wafer 70 is scattered toward an inner surface of the sidewall 211 and an inner surface of the top plate 212 of the first process bowl 210 due to a rotation force of the wafer 70. The process liquid adhered to the inner surfaces of the sidewall 211 and the top plate 212 of the first process bowl 210 flows along the sidewall 211 and the top plate 212 of the first process bowl 210 in a gravity direction to reach the guide part 213, and then, the process liquid flows along an inner surface of the guide part 213 in the gravity direction and is recovered into the first recovery vat 230.

When the cleaning process is performed after the polishing process is performed, the spin head 110 is disposed below the top plate 222 of the second process bowl 220 and above the first process bowl 210. During the cleaning process, the spin head 110 is rotated. Thus, a process liquid sprayed onto the wafer in the cleaning process is scattered toward inner surfaces of the top plate 222 and the sidewall 221 of the second process bowl 220 and an outer surface of the first process bowl 210. The sidewall 211 of the first process bowl 210 is disposed above the bottom plate 241 of the second recovery vat 240. The process liquid adhered to the outer surface of the first process bowl 210 flows along the outer surface of the first process bowl 210 in the gravity direction and is recovered into the second recovery vat 240. Also, the process liquid adhered to the inner surface of the second process bowl 220 flows along the inner surface of the second process bowl 220 in the gravity direction and is recovered into the second recovery vat 240.

As described above, the first recovery vat 230 recovers the process liquid used for the polishing process, and the second recovery vat 240 recovers the process liquid used for the cleaning process. As a result, since the bowl unit 200 may separately recover the process liquid used for each processes performed within the bowl unit 200, the process liquid may be easily reused and recovered.

The first recovery vat 230 is connected to the first recovery tube 251, and the second recovery vat 240 is connected to the second recovery tube 252. The first recovery tube 251 is coupled to the bottom plate 231 of the first recovery vat 230. A first recovery hole 231*b* communicating with the first recovery tube 251 is defined in the bottom plate 231 of the first recovery vat 230. The process liquid recovered into the first recovery space RS1 of the first recovery vat 230 is discharged to the outside through the first recovery tube 251 via the first recovery hole 231*b*.

Although the bowl unit 200 includes two process bowls 210 and 220 and two recovery vats 230 and 240 in this embodiment, the number of the process bowls 210 and 220 and the recovery vats 230 and 240 may increase according to the number of the process liquids used for the polishing and cleaning processes and the number of the process liquids to be separately recovered.

The first recovery tube 251 is coupled to the bottom plate 241 of the second recovery vat 240. A second recovery hole 241*b* communicating with the second recovery tube 252 is defined in the bottom plate 241 of the second recovery vat 240. The process liquid recovered into the second recovery space RS2 of the second recovery vat 240 is discharged to the outside through the second recovery tube 252 via the second recovery hole 241*b*.

Although the first recovery tube 251 and the second recovery tube 252 are respectively provided in one, the number of the first and second recovery tubes 251 and 252 may increase according to sizes and recovery efficiency of the first and second recovery vats 230 and 240.

The vertically movable ascending/descending member 260 is disposed outside the second process bowl 220. The ascending/descending member 260 is coupled to the sidewall 221 of the second process bowl 220 to adjust vertical positions of the first and second process bowls 210 and 220. Particularly, the ascending/descending member 260 may include a bracket 261, a movement shaft 262, and a driver 263. The bracket 261 is fixed to the outer sidewall 221 of the second process bowl 220 and coupled to the movement shaft 262. The movement shaft 262 is connected to the driver 263 and vertically moved by the driver 263.

The first and second process bowls 210 and 220 descend by the ascending/descending member 260 to allow the spin head 110 to protrude upwardly from the first and second process bowls 210 and 220 when the wafer 70 is seated on the spin head 110 or lift from the spin head 110. When the first and second process bowls 210 and 220 descend, the first and second sidewalls 232 and 233 and the connection part 234 of the first recovery vat 230 are inserted into a space defined by the sidewall 211 of the first process bowl 210 and the first and second guide wall 213*a* and 213*b*.

Also, when the polishing and cleaning processes are performed on the wafer 10, the first and second process bowls 210 and 220 ascend and descend by the ascending/descending member 260 to adjust a relative vertical position between the first and second process bowls 210 and 220 and the spin head 110, thereby separately recovering the process liquid used for the polishing process and the process liquid used for the cleaning process.

In this embodiment, although the first and second process bowls 210 and 220 are vertically moved to change the relative vertical position between the first and second process bowls 210 and 220 and the spin head in the substrate polishing unit 1000, the inventive concept is not limited thereto. For example, the spin head 110 may be vertically moved to change the relative vertical position between the first and second process bowls 210 and 220 and the spin head 110.

The polishing unit 300, the first and second process fluid supply units 400 and 500, the brush unit 600, the aerosol unit 700, and the pad conditioning unit 800 are disposed outside the bowl unit 200.

The polishing unit 300 chemically and mechanically polishes a surface of the wafer 70 fixed to the substrate supporting unit 100 to planarize the surface of the wafer 70. A configuration of the polishing unit 300 will be described in detail with reference to FIGS. 5 through 13.

The first and second process fluid supply units 400 and 500 spray process fluids required for the polishing and cleaning processes of the wafer 70 onto the wafer 70 fixed to the substrate supporting unit 100. The first process fluid supply unit 400 faces the polishing unit 300 with the bowl unit 200 therebetween. The first process fluid supply unit 400 is fixed to the sidewall 221 of the second process bowl 220. When the polishing process or the cleaning process is performed, the first process fluid supply unit 400 sprays the process fluid onto the wafer 70 fixed to the spin head 110 to clean the wafer 70. The first process fluid supply unit 400 may include a plurality of injection nozzles fixed to an upper end of the sidewall 221 of the second process bowl 220. The respective injection nozzles spray the process fluid toward a center region of the wafer 70. The process fluid sprayed from the injection nozzles may be a process liquid for cleaning or drying the wafer 70 or a dry gas for drying the wafer 70.

In an example of the inventive concept, although the first process fluid supply unit 400 includes four injection nozzles, the number of the injection nozzles may increase or decrease according to the number of the process fluid used for cleaning the wafer 70.

The second process fluid supply unit 500 faces the polishing unit 300 with the bowl unit 200 and the first process fluid supply unit 400 therebetween. The second process fluid supply unit 500 includes a chemical liquid nozzle for spraying the process liquid. When the cleaning process is performed, the second process fluid supply unit 500 sprays the process liquid onto the wafer 70 fixed to the spin head 110 to clean the wafer 70. The second process fluid supply unit 500 is swingable. When the cleaning process is performed, the second process fluid supply unit 500 is swung to spray the process liquid in a state where the chemical liquid nozzle is disposed above the spin head 100.

The brush unit 600 physically removes foreign substances remaining on the surface of the wafer 70 after the polishing process is performed. The brush unit 600 is swingable and includes a brush pad. The brush pad contact the surface of the wafer 70 to physically brush the foreign substances remaining on the surface of the wafer 70. When the cleaning process is performed, the brush unit 600 rotates the brush pad to clean the wafer 70 fixed to the spin head 110 through its swing operation in a state where the brush pad is disposed above the spin head 110.

The aerosol unit 700 is disposed at a side of the brush unit 600. The aerosol unit sprays the process liquid having fine particles onto the wafer 70 fixed to the spin head 110 at a high pressure to remove the foreign substances remaining on the surface of the wafer 70. For example, the aerosol unit 700 sprays the process liquid in a fine particle form using supersonic waves. The brush unit 600 is used for removing the foreign substances having relatively large particles, and the aerosol unit 700 is used for removing the foreign substances having relatively small particles.

The pad conditioning unit 800 cleans and recycles the polishing unit 300 when the polishing unit 300 is disposed within a home port in a standby state. A configuration of the pad conditioning unit 800 will be described in detail with reference to FIG. 14.

As described above, in the substrate processing system 2000, since all of the polishing and cleaning processes of the wafer 70 are performed in the respective substrate polishing units, there is no need to transfer the wafer 70 into a chamber for cleaning process after the polishing process is performed. Thus, a separate chamber for cleaning process is not required. Therefore, a transfer time and process time of the wafer 70 may be reduced to improve productivity and reduce the foot print.

Hereinafter, a configuration of the polishing unit 300 will be described in detail with reference to accompanying drawings.

Figure 5:
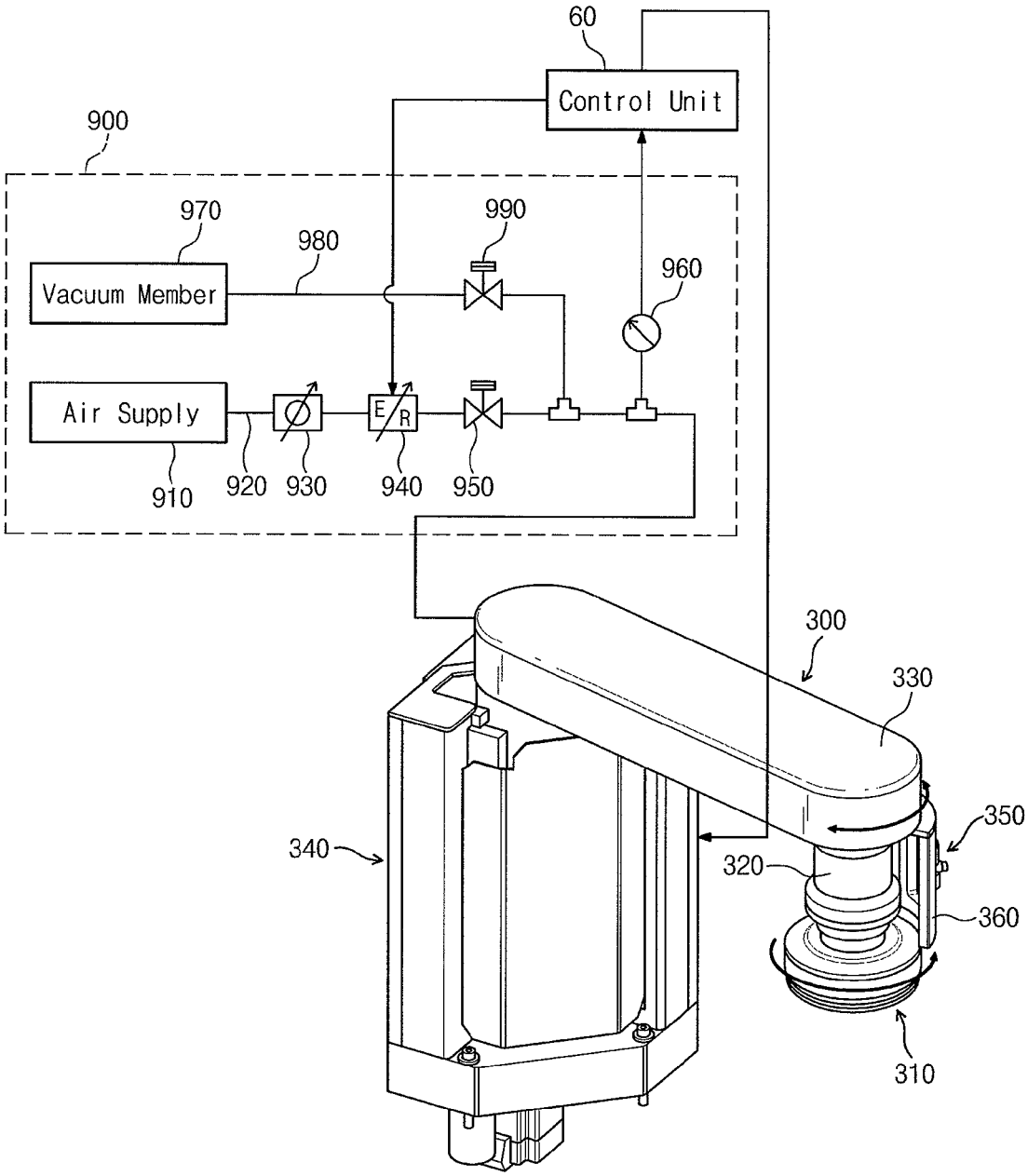
FIG. 5 is a perspective view illustrating a polishing unit of FIG. 3.
Figure 6:
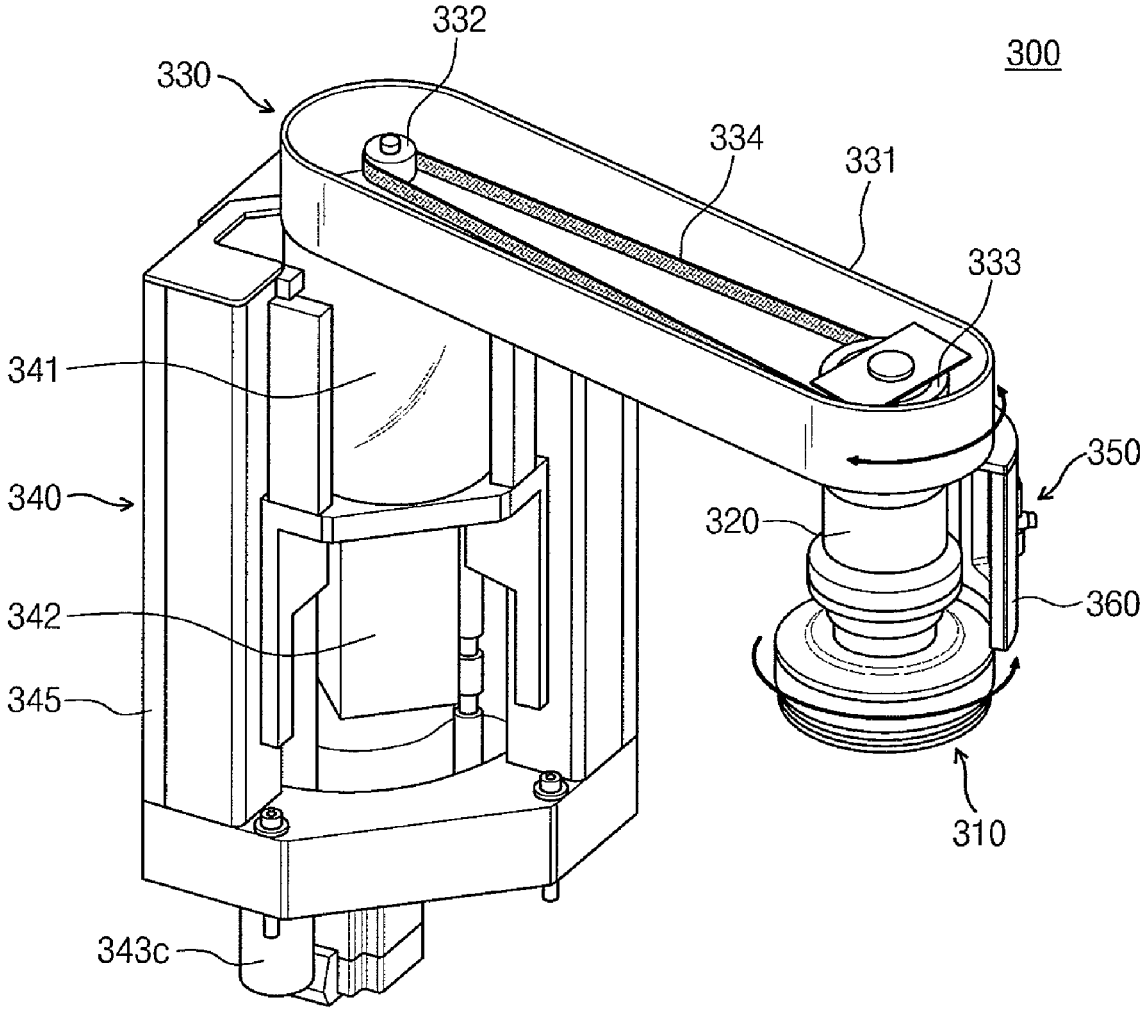
FIG. 6 is a partially exploded perspective view illustrating the polishing unit of FIG. 5.
Figure 7:
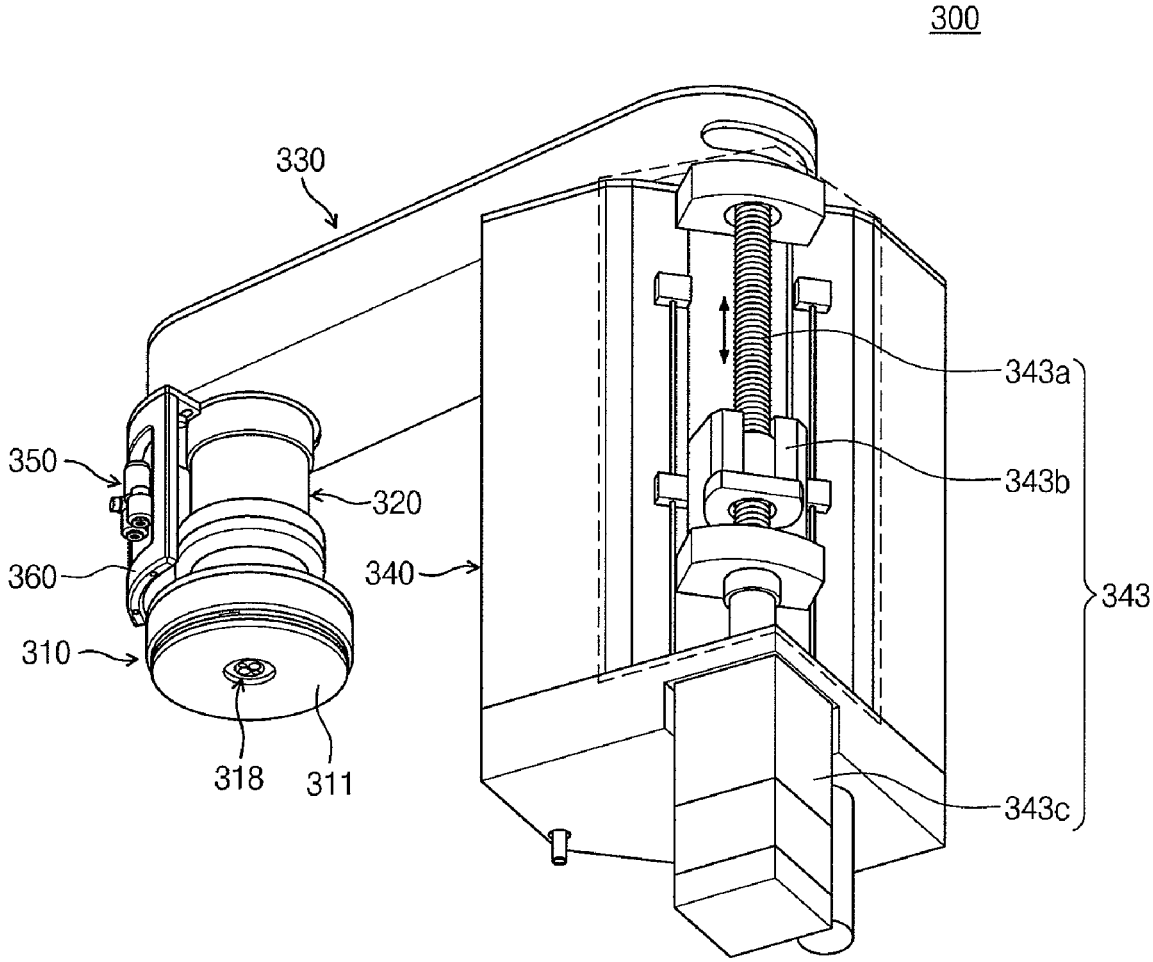
FIG. 7 is a partially exploded perspective view illustrating a rear surface of the polishing unit of FIG. 5.

FIG. 5 is a perspective view illustrating a polishing unit of FIG. 3, and FIG. 6 is a partially exploded perspective view illustrating the polishing unit of FIG. 5. FIG. 7 is a partially exploded perspective view illustrating a rear surface of the polishing unit of FIG. 5, and FIG. 8 is a partially sectional perspective view illustrating the polishing unit of FIG. 5.

Referring to FIGS. 4 and 5, the polishing unit 300 may include a compressing part 310, a fluid supply part 320, a swing part 330, and a driving part 340.

Particularly, the compressing part 310 is disposed above the wafer 70 fixed to the spin head 110 during the polishing process. The compressing part 310 is rotated in a state where it contacts the top surface of the wafer 70 so as to polish the wafer 70. In an example of the inventive concept, when the polishing process is performed, the compressing part 310 is rotated in a state where it contacts the top surface of the wafer 70, and simultaneously, sprays a chemical liquid for polishing the wafer 70 on the wafer 70. The fluid supply part 320 is disposed on the compressing part 320. The fluid supply part 320 supplies the chemical liquid to the compressing part 310. The fluid supply part 320 receives a rotation force from the driving part 340 through the swing part 330, and thus is rotated together with the compressing part 310. Configurations of the compressing part 310 and the fluid supply part 320 will be described with reference to FIGS. 9 through 12.

Figure 8:
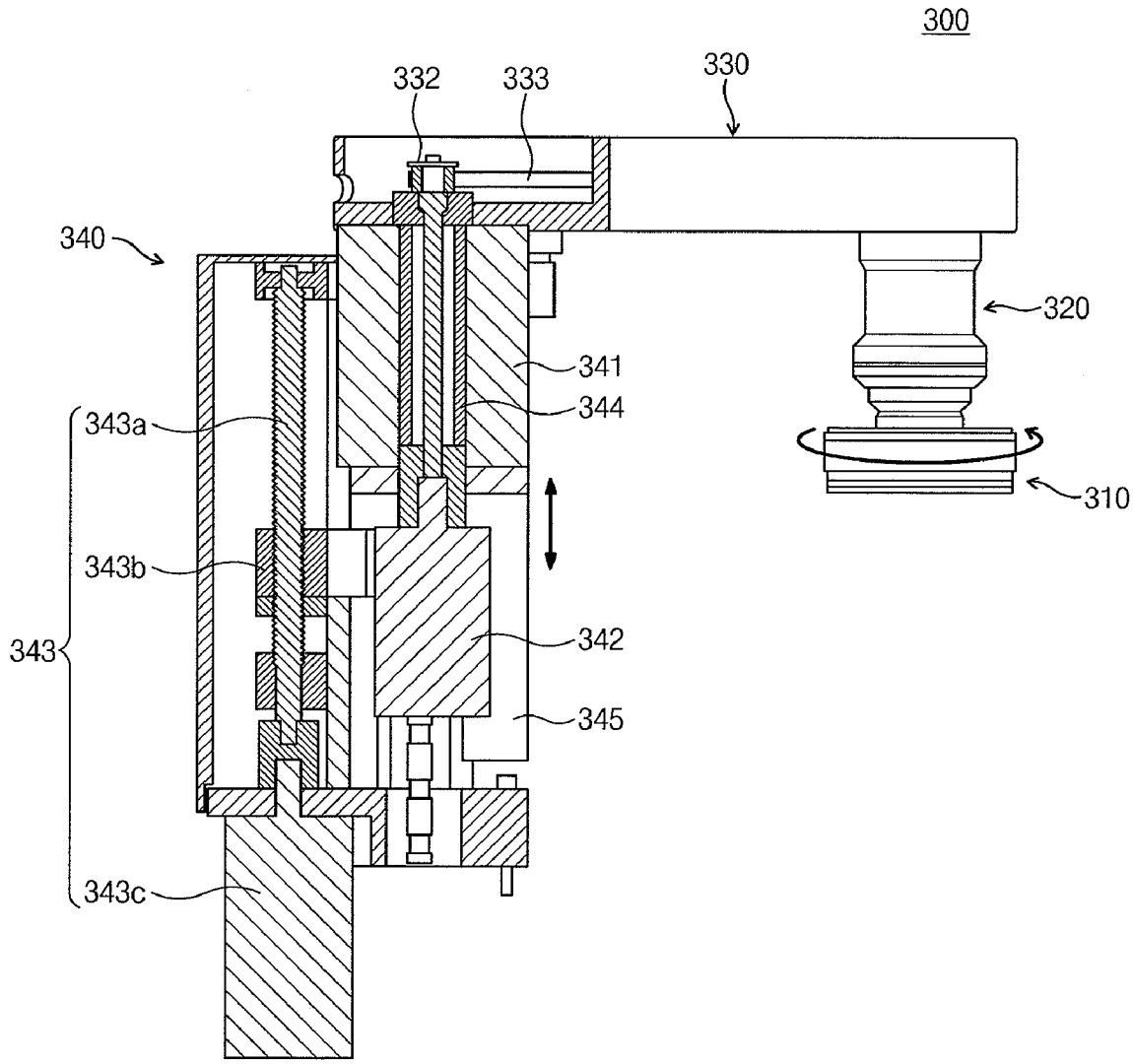
FIG. 8 is a partially sectional perspective view illustrating the polishing unit of FIG. 5.

Referring to FIGS. 6 through 8, the swing part 330 is disposed above the fluid supply part 320. The swing part 330 may include a swing case 331 having a bar shape and a belt-pulley assembly 335 transmitting a rotation force from the driving part 340 to the fluid supply part 320. The swing case 331 has one side coupled to the fluid supply part 320 and the other side coupled to the driving part 340.

The driving part 340 may include a first driving motor 341 for rotating the swing part 330, a second driving motor 342 for rotating the fluid supply part 320, and a vertical movement part 343 for adjusting a vertical position of the compressing part 310.

The first driving motor 341 is coupled to the swing case 331 to provide the rotation force to the swing case 331. The first driving motor 341 may alternately and repeatedly provide the rotation force in clockwise and counterclockwise directions. Thus, the swing part 330 may be swung by the driving part 340 about a central axis at which it is coupled to the driving part 340. When the polishing process is performed, the compressing part 310 may be horizontally reciprocated in a circular arc shape at an upper portion of the wafer 70 disposed on the spin head 110 (referring to FIG. 4) by the swing operation of the swing part 330.

The second driving motor 342 is disposed below the first driving motor 341. The second driving motor 342 provide a rotation force to the belt-pulley assembly 335. The belt-pulley assembly 335 transmits the rotation force of the second driving motor 342 to the fluid supply part 320. The belt-pulley assembly 335 is built in the swing case 331 and may include a driving pulley 332, a driven pulley 333, and a belt 334. The driving pulley 332 is disposed above the first driving motor 341 and coupled to one side of a vertical arm 344 passing through the first driving motor 341. The second driving motor 342 is coupled to the other side of the vertical arm 344.

The driven pulley 333 faces the driving pulley 332. The driven pulley 333 is disposed above the fluid supply part 320 and coupled to the fluid supply part 320. The driving pulley 332 and the driven pulley 333 are connected to each other through the belt 334. The belt 334 is wound around the driving pulley 332 and the driven pulley 333.

The rotation force of the second driving motor 342 is transmitted to the driving pulley 332 through the vertical arm 344. Thus, the driving pulley 332 is rotated. The rotation force of the driving pulley 332 is transmitted to the driven pulley 333 through the belt 334. Thus, the driven pulley 333 is rotated. The rotation force of the driven pulley 333 is transmitted to the fluid supply part 320. Thus, the compressing part 310 and the fluid supply part 320 are rotated.

The vertical movement part 343 is disposed at a rear side of the first driving motor 341 and the second driving motor 342. The vertical movement part 343 may include a ball screw 343*a*, a nut 343*b*, and a third driving motor 343*c*. The ball screw 343*a* has a substantially bar shape and is vertically disposed with respect to the ground surface. The nut 343*b* is inserted into the ball screw 343*a* and fixed to the second driving motor 342. The third driving motor 343*c* is disposed below the ball screw 343*c*. The third driving motor 343*c* may be coupled to the ball screw 343*a* to provide the rotation force to the ball screw 343*a* in clockwise and counterclockwise directions. The ball screw 334*a* is rotated in the clockwise and counterclockwise directions by the third driving motor 343*c*. The nut 343*b* is vertically moved along the ball screw 343*a* by the rotation of the ball screw 343*a*. Thus, the second driving motor 342 coupled to the nut 343*b* is vertically moved together with the nut 343*b*. As the second driving motor 342 is vertically moved, the first driving motor 341 and the swing part 330 are vertically moved, and thus, the fluid supply part 320 and the compressing part 310 are vertically moved also.

Although the vertical movement part 343 includes the ball screw 343*a*, the nut 343*b*, and the third driving motor 343*c* to provide a vertical movement force using a linear motor method in this embodiment, the inventive concept is not limited thereto. For example, the vertical movement part 343 may include a cylinder to provide a vertical movement force.

The first driving motor 341, the second driving motor 342, the ball screw 343*a*, the nut 343*b*, and the vertical arm 344 are built in a driving case 345. The driving case 345 has a long bar shape in a vertical direction.

Hereinafter, the compressing part 310 and the fluid supply part 320 are described in detail with reference to accompanying drawings.

Figure 9:
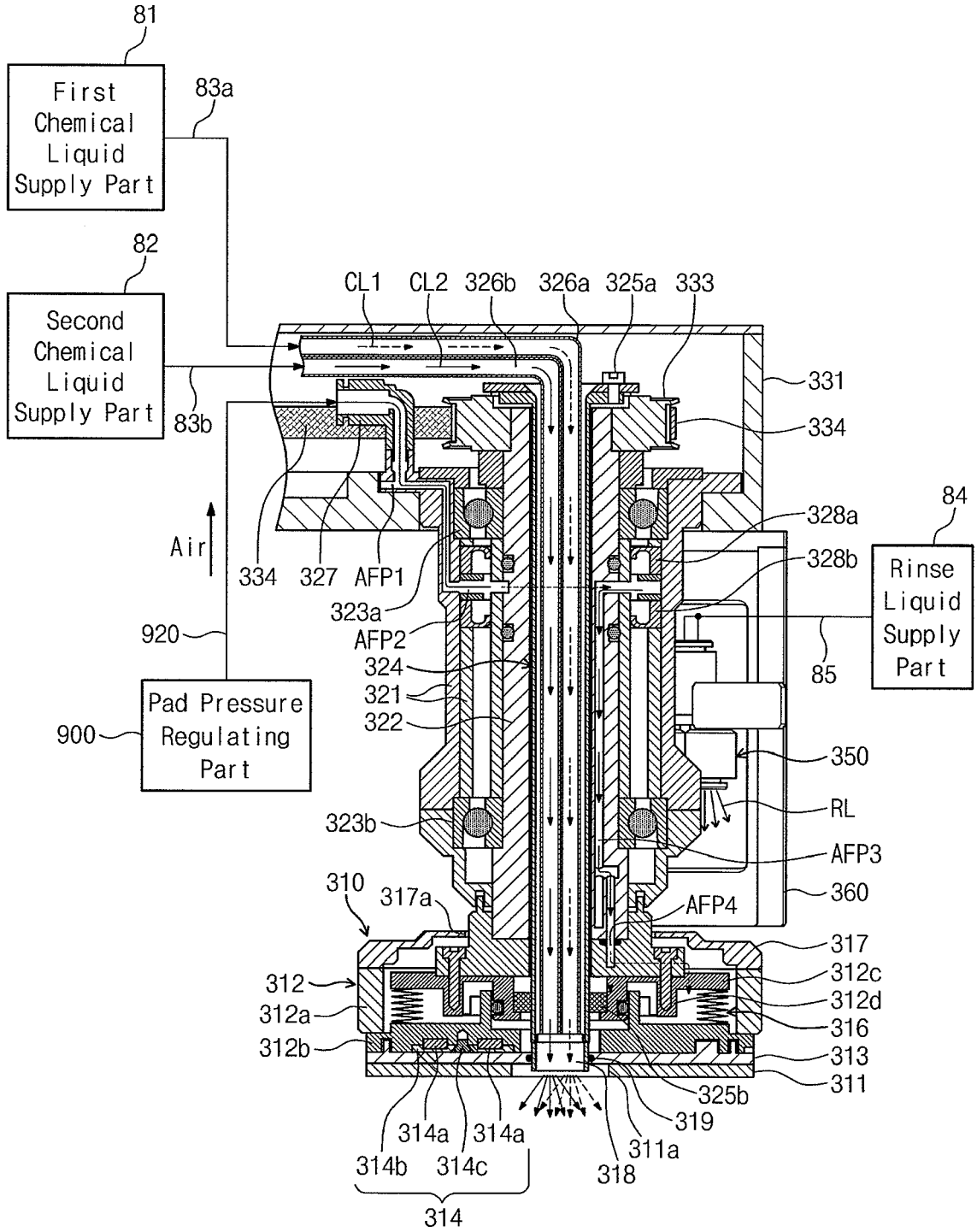
FIG. 9 is a longitudinal sectional view illustrating a compressing part and a fluid supply part of FIG. 5.

FIG. 9 is a longitudinal sectional view illustrating a compressing part and a fluid supply part of FIG. 5.

Referring to FIGS. 5 through 9, the fluid supply part 320 provides a chemical liquid for polishing a wafer to the compressing part 310. Also, the fluid supply part 320 is rotated by the rotation force transmitted from the driving part 340 to rotate the compressing part 310.

Particularly, the fluid supply part 320 may include a housing 321, a rotation shaft 322, first and second bearings 323*a* and 323*b*, a fixed shaft 324, first and second chemical liquid tubes 326*a* and 326*b*, an air injection tube 327, and first and second rotary lip seals 328*a* and 328*b*.

The housing 321 has a substantially cylindrical tube shape. An upper end of the housing 321 is inserted into the swing case 331 of the swing part 330. Thus, the housing 321 has the upper end coupled to the swing case 331 and a lower end coupled to the compressing part 310.

The rotation shaft 322 is disposed within the housing 321 and spaced from the housing 321. The rotation shaft 322 is a hollow tube extending in a longitudinal direction of the housing 321. An upper end of the rotation shaft 322 is inserted and coupled into/to the driven pulley 333 of the swing part 330, and the rotation shaft 322 is rotated by the rotation of the driven pulley 333. A lower end of the rotation shaft 322 is coupled to the compressing part 310, and the compressing part 310 is rotated by the rotation of the rotation shaft 322. That is, the rotation force of the second driving motor 342 (see FIG. 6) is transmitted sequentially in order to the vertical arm 344 (see FIG. 8), the driving pulley 332, the belt 334, the driven pulley 333, the rotation shaft 322, and the compressing part 310 to rotate the compressing part 310 about a center axis.

The first and second bearings 323*a* and 323*b* are disposed between the housing 321 and the rotation shaft 322. The first and second bearings 323*a* and 323*b* connect the housing 321 to the rotation shaft 322 and support the rotation shaft 322 such that the rotation shaft 322 is stably rotated. The first bearing 323*a* is disposed adjacent to the swing part 330, and the second bearing 323*b* is disposed adjacent to the compressing part 310. Inner races of the first and second bearings 323*a* and 323*b* are inserted into the rotation shaft 322, and thus rotated together with the rotation shaft 322. Outer races of the first and second bearings 323*a* and 323*b* are coupled to the housing 321, and thus not rotated when the rotation shaft 322 is rotated. Thus, only the rotation shaft 322 is rotated, and the housing 321 is not rotated.

The fixed shaft 324 is disposed inside the rotation shaft 322. The fixed shaft 324 is a hollow tube extending in the same direction as the rotation shaft 332. The fixed shaft 324 is spaced from the rotation shaft 322 and not rotated when the rotation shaft 324 is rotated. An upper end of the fixed shaft 324 is inserted into the swing case 331 and coupled with a first shaft bracket 325*a* fixed to the swing case 331. Thus, the fixed shaft 324 is coupled with the swing case 331. A lower end of the fixed shaft 324 is inserted into the compressing part 310 and coupled with a second shaft bracket 325*b* disposed inside the compressing part 310. Thus, the fixed shaft 324 is coupled with the compressing part 310.

The first and second chemical liquid tubes 326*a* and 326*b* are disposed inside the fixed shaft 324. The first and second chemical liquid tubes 326*a* and 326*b* extend in the same direction as the fixed shaft 324 within the fixed shaft 324 and are disposed parallel to each other. The first and second chemical liquid tubes 326*a* and 326*b* provide transfer flow paths of the chemical liquid used for the polishing process, and output ends through which the chemical liquid is discharged are disposed within the compressing part 310.

An input end of the first chemical liquid tube 326*a* is connected to a first chemical liquid supply line 83*a*. The first chemical liquid supply line 83*a* is connected to a first chemical liquid supply part 81 supplying a first chemical liquid CL1 used for polishing the wafer. The first chemical liquid tube 326*a* receives the first chemical liquid CL1 from the first chemical liquid supply part 81 through the first chemical liquid supply line 83*a*.

An input end of the second chemical liquid tube 326*b* is connected to a second chemical liquid supply line 83*b*. The second chemical liquid supply line 83*b* is connected to a second chemical liquid supply part 82 supplying a second chemical liquid CL2 used for polishing the wafer. The second chemical liquid tube 326*b* receives the second chemical liquid CL2 from the second chemical liquid supply part 82 through the second chemical liquid supply line 83*b*.

In this embodiment, the first and second chemical liquids CL1 and CL2 may be chemical liquids different from each other or the same chemical liquid as each other. For example, the chemical liquids CL1 and CL2 discharged from the first and second chemical liquid tubes 326*a* and 326*b* may include slurries for polishing the wafer.

In an example of the inventive concept, the first and second chemical liquid tubes 326*a* and 326*b* are connected to the first and second chemical liquid supply lines 83*a* and 83*b* disposed at the outside via the swing case 331, respectively.

The air injection tube 327 is disposed on an upper end of the housing 321. The air injection tube 327 is connected to a pad pressure regulating part 900 and receives air from the pad pressure regulating part 900. In and example of the inventive concept, the air injection tube 327 is disposed inside the swing case 331.

The air injection tube 327 communicates with a first air flow path AFP1 disposed in the housing 321. Air injected into the air injection tube 327 in introduced into the first air flow path AFP1. The first air flow path AFP1 is disposed in a wall of the housing 321 and extends along the longitudinal direction of the housing 321 from an upper end of the housing 321. An output end of the first air flow path AFP1 communicates with a second air flow path AFP2 disposed between the housing 321 and the rotation shaft 322. The air introduced into the first air flow path AFP1 is introduced into the second air flow path AFP2.

The second air flow path AFP2 is defined by the first and second rotary lip seals 328*a* and 328*b*. The first and second rotary lip seals 328*a* and 328*b* are disposed between the housing 321 and the rotation shaft 322 to seal a space between the housing 321 and the rotation shaft 322. The first and second rotary lip seals 328*a* and 328*b* face each other and have substantially ring shapes. The first rotary lip seal 328*a* is disposed below the first bearing 323*a* and adjacent to the first bearing 323*a*. The second rotary lip seal 328*b* is disposed below the first rotary lip seal 328*a* and spaced from the first rotary lip seal 328*a*. A space spaced between the first rotary lip seal 328*a* and the second rotary lip seal 328*b* serves as the second air flow path AFP2. The second air flow path AFP2 surrounds the rotation shaft 322.

The second air flow path AFP2 communicates with a third air flow path AFP3 disposed inside a wall of the rotation shaft 322. Air introduced into the second air flow path AFP2 is introduced into the third air flow path AFP3. The third air flow path AFP3 extends from a position connected to the second air flow path AFP2 to a lower end of the rotation shaft 322 in a longitudinal direction of the rotation shaft 322. The air injected from the pad pressure regulating part 900 flows sequentially in order of the air injection tube 327, the first air flow path AFP1, the second air flow path AFP2, and the third air flow path AFP3, and then is provided to the compressing part 310.

The compressing part 310 is disposed below the fluid supply part 320. The compressing part 310 polishes the surface of the wafer while the compressing part 310 compresses the surface of the wafer. When the polishing process is performed, a pressure applied to the wafer by the compressing part 310 is controlled by a pressure of air introduced into the compressing part 310 through the third air flow path AFP3.

Referring to FIGS. 5, 7, and 9, the compressing part 310 may include a polishing pad 311, a polishing body 312, a pad holder 313, a clamp member 314, a coupling plate 315, a bellows 316, a cover 317, and a chemical liquid nozzle 318.

The polishing pad 311 has a plate shape and an approximately circular ring shape. The polishing pad 311 is rotated to polish the wafer in a state where a bottom surface of the polishing pad 311 contacts a top surface of the wafer during the polishing process. The polishing pad 311 has a diameter less than that of the wafer. During the polishing process, the polishing pad 311 is swung by the driving part 340 to polishes the wafer. As described above, since the polishing pad 311 has a diameter less than that of the wafer, the polishing pad may locally polish the wafer to prevent a specific region from being excessively polished.

The polishing body 312 is disposed above the polishing pad 311. The polishing body 312 has an approximately circular ring shape and is coupled to the fixed shaft 324 of the fluid supply part 320. Specifically, the polishing body 312 may include a polishing housing 312*a*, a lower plate 312*b*, and an upper plate 312*c*.

The polishing housing 312*a* has an approximately cylindrical shape. The lower plate 312*b* is disposed below the polishing housing 312*a*. The lower plate 312*b* has an approximately circular ring shape and the same size as the polishing pad 311. The lower plate 312*b* is coupled to a lower portion of the polishing housing 312*a* to seal the lower portion of the polishing housing 312*a*.

The polishing pad 311 is disposed below the lower plate 312*b*. The pad holder 313 is disposed between the polishing pad 311 and the lower plate 312*b*. The pad holder 313 allows the polishing pad 311 to be detachably fixed to the polishing body 312. That is, a bottom surface of the pad holder 313 is coupled to a top surface of the polishing pad 311 and a top surface thereof is detachably coupled to the lower plate 312*b* by the clamp member 314.

The clamp member 314 is disposed between the lower plate 312*b* and the pad holder 313. The clamp member 314 fixes the pad holder 313 to the lower plate 312*b* using a magnetic force. Specifically, the clamp member 314 includes a magnet 314*a*, a clamp plate 314*b*, and a screw 314*c*. The magnet 314*a* is disposed between the clamp plate 314*b* and the lower plate 312*b*. The magnet 314*a* has an approximately circular ring shape. In an example of the inventive concept, although the clamp member 314 includes the magnet 314*a* having the ring shape, the number of the magnet 314*a* may increase according to sizes of the clamp member 314 and the magnet 314*a*. Also, the magnet 314*a* may have various shapes. The clamp member 314*b* faces the lower plate 312*b* and is coupled to the lower plate 312*b* using the screw 314*c*. Since the clamp plate 314*b* may be formed of a material having non-magnetic characteristics, e.g., aluminium, the clamp plate 314*b* does not react to the magnet 312*a*. On the other hand, since the pad holder 313 may be formed of a material having magnetic characteristics, e.g., a stainless steel or a carbon steel, the pad holder 313 is coupled to the lower plate 312*b* due to the magnet force of the magnet 312*a*.

As described above, since the clamp member 314 fixes the pad holder 313 to the lower plate 312*b* using the magnet force, the pad holder 313 may be easily attached or detached to the lower plate 312*b*. That is, since the polishing pad 311 is a supply, the polishing pad 311 should be periodically replaced. Thus, a process in which the pad holder 313 is fixed to the lower plate 312*b* and a process in which the pad holder is separated from the lower plate 312*b* frequently occur. In the compressing part 310, since the pad holder 313 is coupled to the lower plate 312*b* by the magnetic force of the clamp member 314, a time for replacing the polishing pad 311 may be reduced. Thus, in the compressing part 310, a process standby time may be reduced, and productivity may be improved.

In an example of the inventive concept, an insertion groove in which a portion of the magnet 314*a* is inserted into a portion of the clamp plate 314*b* at which the magnet 314*a* is disposed is defined in the clamp plate 314*b*. Also, insertion grooves in which the magnet 314*a* and the clamp plate 314*b* are inserted into portions at which the clamp member 314 is coupled are defined in the lower plate 312*b*.

Although one clamp member 314 is provided in FIG. 9, the pad holder 313 may be coupled to the lower plate 312*b* using a plurality of clamp members 314.

The lower plate 312*b* is coupled to the upper plate 312*c*. The upper plate 312*c* is disposed above the lower plate 312*b* and faces the lower plate 312*b*. The upper plate 312*c* is disposed inside the polishing housing 312*a* to seal the upper portion of the polishing housing 312*b*. The upper plate 312*c* has an approximately circular ring shape.

The upper plate 312*c* is coupled and fixed to the coupling plate 315 disposed on the lower plate 312*b*. The coupling plate 351 is coupled to the rotation shaft 322 of the fluid supply part 320 and rotated together with the rotation shaft 322. Thus, the entire compressing part 310 is rotated. The coupling plate 351 has an approximately circular plate. A fourth air flow path AFP4 through which the air discharged from the rotation shaft 322 flows is disposed inside the coupling plate 351. The fourth air flow path AFP4 communicates with the third air flow path AFP3 of the rotation shaft 322 to receive the air through the third air flow path AFP3. The air introduced into the fourth air flow path AFP4 is injected into the bellows 316.

The bellows 316 is disposed within a space between the lower plate 312*b* and the upper plate 312*c* inside the polishing housing 312*a*. The bellows 316 is formed of a metallic material. The bellows 316 may be vertically expanded and contracted according to a pressure of the air provided from the fourth air flow path AFP4. When the polishing process is performed, the bellows 316 may be expanded in a state where the polishing pad 311 is closely attached to the wafer. Thus, when the polishing process is performed in the sate where the polishing pad 311 is closely attached to the wafer, the wafer may be uniformly and efficiently polished.

Hereinafter, a process in which the wafer is compressed by the polishing pad 311 will be described in detail with reference to FIGS. 10 through 12.

Figure 10:
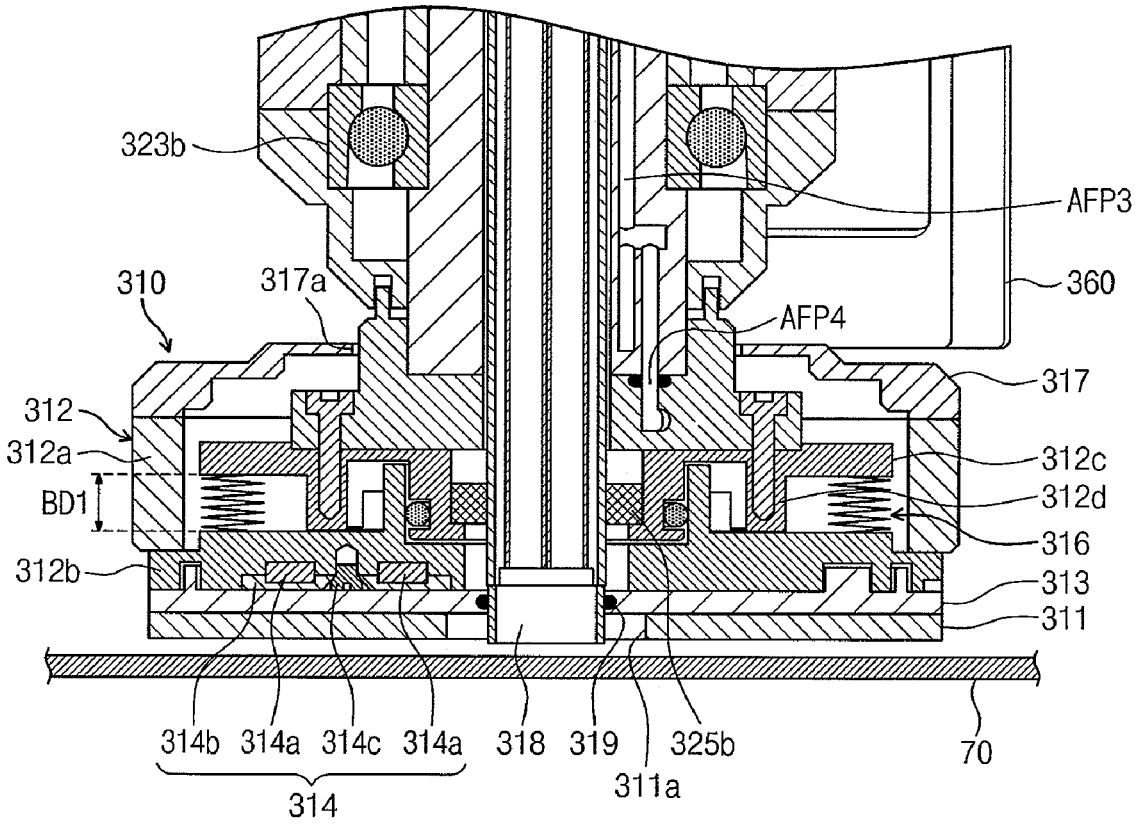
FIG. 10 is a longitudinal sectional view illustrating the compressing part of FIG. 9 in a standby state.
Figure 11:
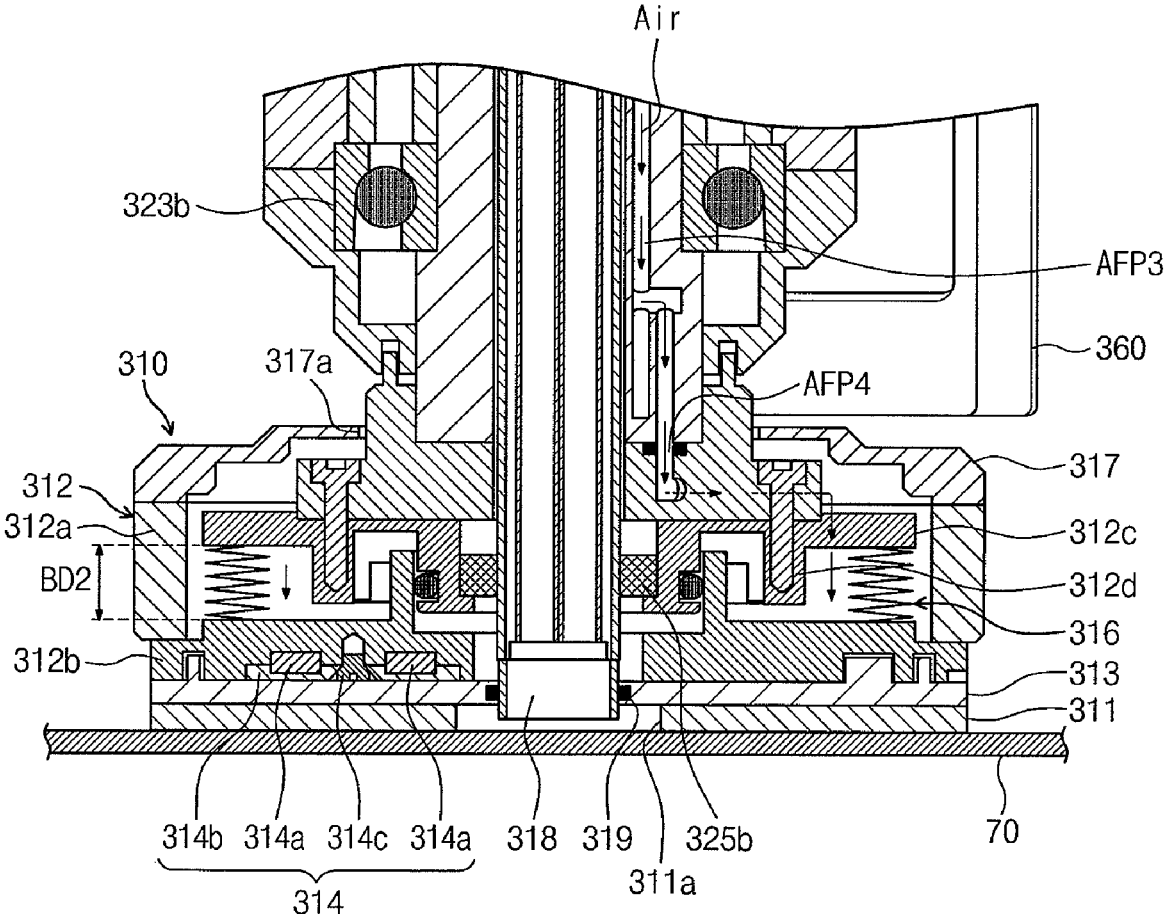
FIGS. 11 and 12 are longitudinal sectional views of a state in which a wafer is polished by the compressing part of FIG. 9.
Figure 12:
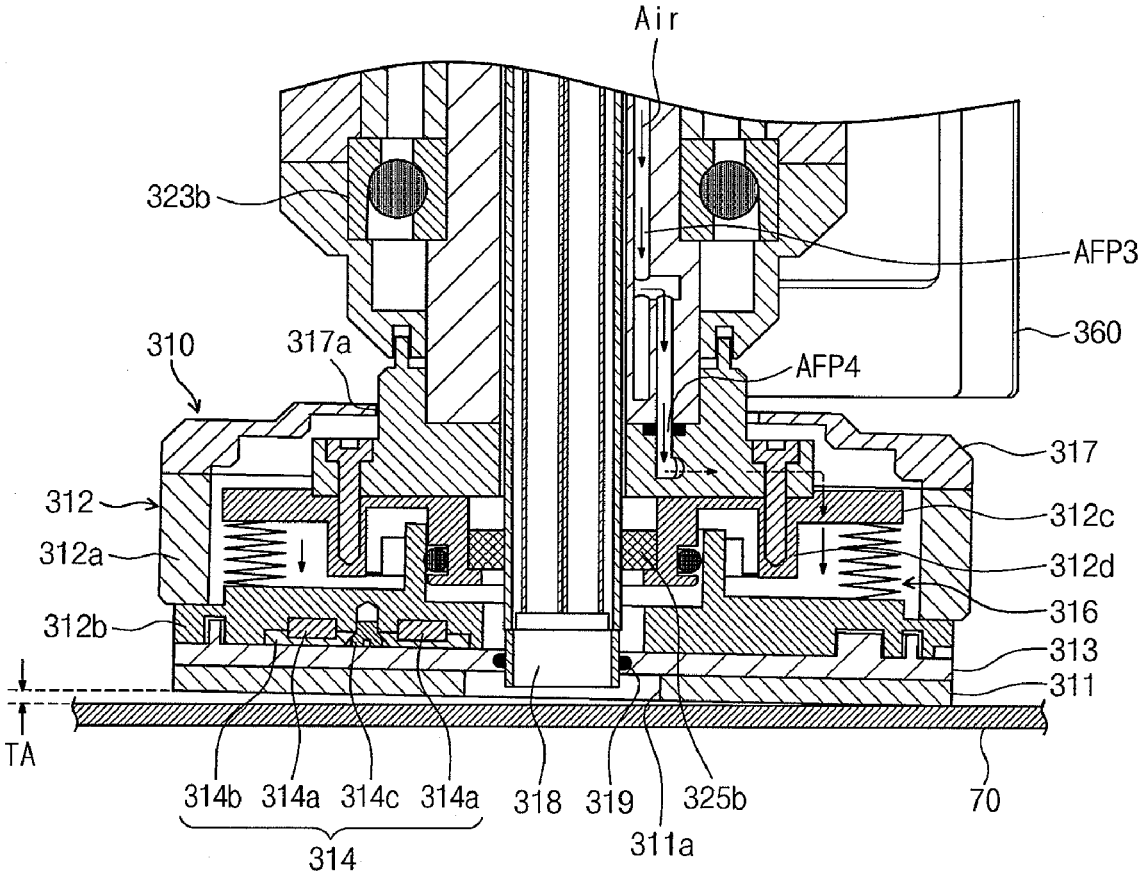

FIG. 10 is a longitudinal sectional view illustrating the compressing part of FIG. 9 in a standby state, and FIGS. 11 and 12 are longitudinal sectional views of a state in which a wafer is polished by the compressing part of FIG. 9.

Referring to FIGS. 9 and 10, for performing the polishing process, the compressing part 310 is disposed above a wafer 70 in a standby state. In the standby state of the compressing part 310, the bellows 316 is contracted by a vacuum pressure provided from the pad pressure regulating part 900. Thus, the lower plate 312*b* is moved toward the upper plate 312*c*, and the polishing pad 311 is spaced from the wafer 70. An internal stopper 312*d* for adjusting a contraction degree of the bellows 316 is disposed in the upper plate 312*c*. The internal stopper 312*d* protrudes from a bottom surface of the upper plate 312*c*. When the bellows 316 is contracted, the internal stopper 312*d* contacts the lower plate 312*b*. The stopper 312*d* stops the lower plate 312*b* from being moved upwardly over a predetermined distance to prevent a distance between the lower plate 312*b* and the upper plate 312*c* from being narrowed to a distance less than the predetermined distance.

Referring to FIGS. 9 and 11, during the polishing process, air is injected from the pad pressure regulating part 900 to the air injection tube 327. The air injected into the air injection tube 327 is injected into the bellows 316 via the first to fourth air flow paths AFP1, AFP2, AFP3, and AFP4 one after the other. The bellows is expanded by a pressure of the injected air. Thus, a length BD2 when the bellows is expanded is greater than that BD1 when the bellows 316 is contracted. When the bellows is expanded, the polishing pad 311 contacts the wafer 70. Then, the compressing part 310 is rotated about a center axis of the polishing pad 311 to polish the wafer 70 in a state where the polishing pad 311 contacts the wafer 70.

Referring to FIGS. 9 and 12, since the polishing pad 311 compresses the wafer 70 due to the bellows 316 in the compressing part 310, the polishing pad may be tiltable. Since the wafer 70 includes a plurality of patterned thin films, a top surface thereof may be uneven. During the polishing process, since the polishing pad 311 is tiltable by the bellows 316, the polishing pad 311 may be closely attached to the surface of the wafer 70. In an example of the inventive concept, the polishing pad 311 may be tilted at an angle TA of about ±1 degree.

A pressure applied to the wafer by the polishing pad 311 is regulated according to a pressure of the air injected into the bellows 316. The air pressure of the bellows 316 is regulated by the pad pressure regulating part 900. A process for regulating the air pressure will be described in a configuration of the pad pressure regulating part 900 that will be described later.

The cover 317 is disposed above the polishing body 312 to cover an upper portion of the polishing body 312. The cover 317 is coupled to an upper end of the polishing housing 312*a* to provide a space in which the coupling plate 315 is received. An opening 317*a* is defined in a central portion of the cover 317. A portion of the coupling plate 315 protrudes through the opening 317*a* and is coupled to the rotation shaft 322. A surface defining the opening 317*a* is spaced from the coupling plate 315 inserted into the opening 317*a* to tilt the polishing pad 311.

Lower ends of the fixed shaft 324 and the first and second chemical liquid tubes 326*a* and 326*b* are inserted into holds respectively defined in central portions of the coupling plate 317, the upper plate 312*c*, and the lower plate 312*b*, respectively. The second shaft bracket 325*b* is disposed between the upper plate 312*c* and the fixed shaft 324. The second shaft bracket 325*b* is coupled to the upper plate 312*c* and fixedly coupled to the lower end of the fixed shaft 324 to fix the fixed shaft 324 to the upper plate 312*c*. The second shaft bracket 325*b* is coupled to the upper plate 312*c* using a bearing (not shown). As a result, the upper plate 312*c* is rotatably coupled to the second shaft bracket 325*b*.

The fixed shaft 324 and the first and second chemical liquid tubes 326*a* and 326*b* inserted into the compressing part 310 are coupled to the chemical liquid nozzle 318. The chemical liquid nozzle 318 is inserted into a hole defined in a central portion of the pad holder 313 and coupled to the pad holder 313. An input end of the chemical liquid nozzle 318 is coupled to the fixed shaft 324 and the first and second chemical liquid tubes 326*a* and 326*b* and communicates with output ends of the first and second chemical liquid tubes 326*a* and 326*b*. An output end of the chemical liquid nozzle 318 is exposed to the outside through a pad hole 311*a* defined in a center of the polishing pad 311. During the polishing process, the first and second chemical liquids CL1 and CL2 supplied from the first and second chemical liquid tubes 326*a* and 326*b* are sprayed onto the wafer 70. According to an example of the inventive concept, in the chemical liquid nozzle 318, the flow path through which the first chemical liquid CL1 supplied from the first chemical liquid tube 326*a* is introduced is separated from the flow path through which the second chemical liquid CL2 supplied from the second chemical liquid tube 326*b* is introduced.

During the polishing process, the fixed shaft 324, the first and second chemical liquid tubes 326*a* and 326*b*, and the chemical liquid nozzle 318 are not rotated, and the polishing pad 311 and the pad holder 313 are rotated. Thus, since the pad holder is rotated in a state where the chemical liquid nozzle 318 is fixed, the chemical liquids CL1 and CL2 sprayed from the chemical liquid nozzle 318 may be introduced into a gap between the pad holder 313 and the chemical liquid nozzle 318 to generate foreign substances. The foreign substances generated between the pad holder 313 and the chemical liquid nozzle 318 may be dropped onto the wafer 70 during the polishing process to cause inferior polishing and wafer contamination.

To overcome these limitations, the compressing part 310 may further include an O-ring 319 between the chemical liquid nozzle 318 and the pad holder 313. The O-ring 319 surrounds the chemical liquid nozzle 318 to prevent the chemical liquids CL1 and CL2 sprayed from the chemical liquid nozzle 318 from being introduced into the compressing part 310. Since the O-ring 319 may be worn by friction due to the rotation of the pad holder 313, the O-ring 319 should be periodically replaced. The replacement of the O-ring 319 may be performed together with the replacement of the polishing pad 311.

The polishing unit 300 may further include a rinse member 350 for preventing the first and second chemical liquids CL1 and CL2 sprayed onto the wafer 70 from being hardened during the polishing process.

Figure 13:
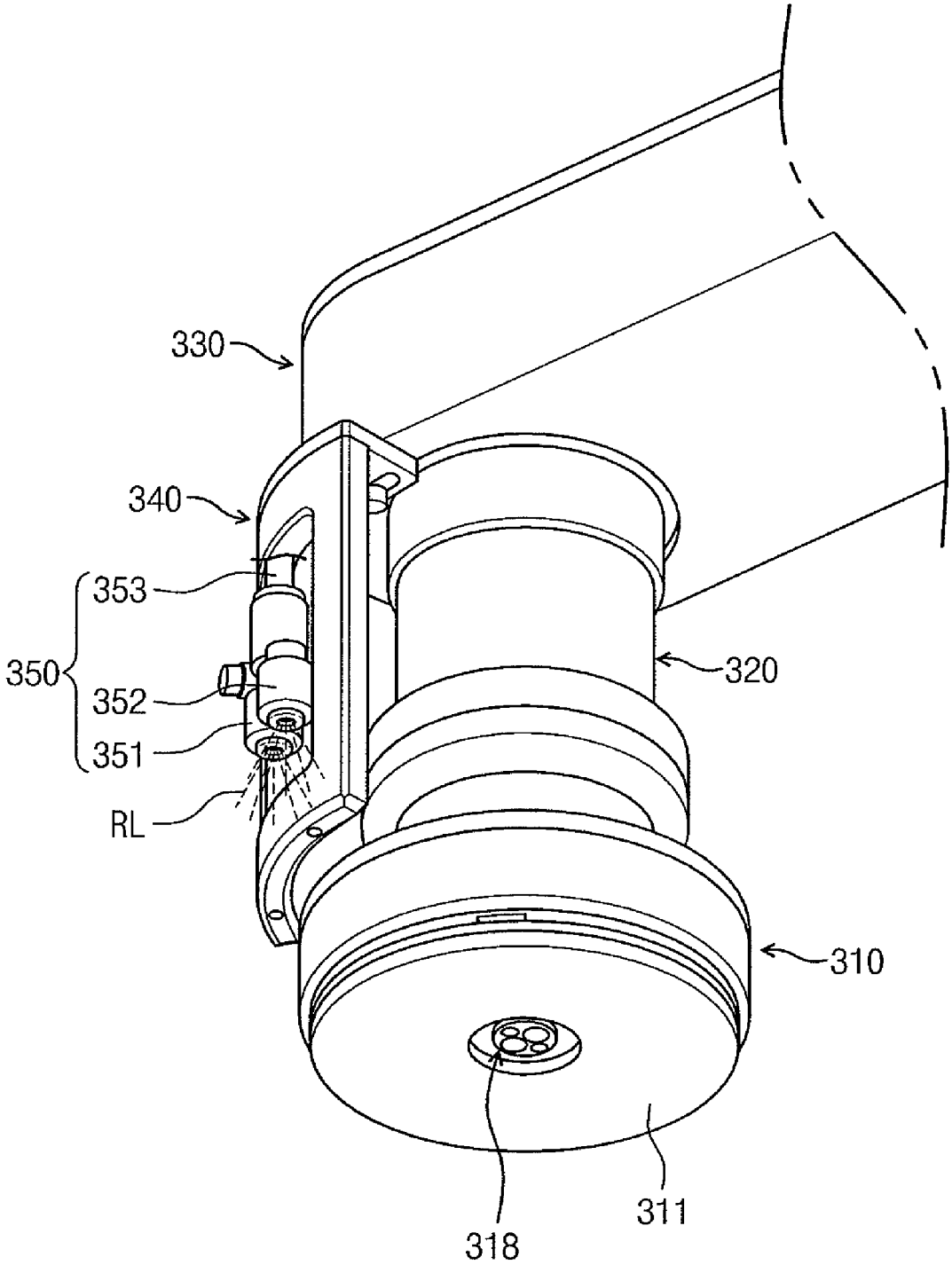
FIG. 13 is a perspective view illustrating a rinse member of FIG. 5.

FIG. 13 is a perspective view illustrating a rinse member of FIG. 5.

Referring to FIGS. 9 and 13, the rinse member 350 is disposed at a side of the fluid supply part 320. The rinse member 350 sprays a rinse liquid RL such as ultrapure water or pure water onto the wafer 70 to prevent the first and second chemical liquids CL1 and CL2 sprayed onto the wafer 70 from being hardened during the polishing process.

Specifically, the rinse member 350 may include first and second rinse nozzles 351 and 352 and a connection tube 353 connected to input ends of the first and second rinse nozzles 351 and 352. The connection tube 353 is connected to a rinse supply line 85, and the rinse supply line 85 is connected to a rinse liquid supply part 84. The rinse liquid supply part 84 supplies the rinse liquid RL to the rinse supply line 85, and the rinse supply line 85 supplies the rinse liquid RL to the connection line 353. The connection tube 353 supplies the rinse liquid RL to the first and second rinse nozzles 351 and 352, and the first and second rinse nozzles 351 and 352 sprays the rinse liquid RL onto the wafer 70.

As described above, the polishing unit 300 may include the rinse member 350 for spraying the rinse liquid RL to prevent the first and second chemical liquids CL1 and CL2 sprayed onto the wafer 70 from being hardened during the polishing process. Particularly, when a high-speed polishing process in which the polishing pad 311 is rotated at a speed of about 800 RPM is performed, slurry sprayed onto the wafer 70 for the polishing process has a thin fluid film thickness when compared to a low-speed polishing process. Thus, the slurry sprayed onto the wafer 70 may be easily hardened during the polishing process. On the other hand, when the low-speed polishing process is performed, the slurry sprayed onto the wafer 70 is pooled on an edge portion of the wafer 70. Thus, the slurry may be hardened in a belt shape at the edge portion of the wafer 70.

To prevent the hardness of the slurry, the rinse member 350 sprays the rinse liquid RL onto the wafer 70 while the polishing pad 311 is rotated to polish the wafer 70. Thus, since the polishing unit 300 prevents the wafer contamination and the inferior polishing from occurring due to the hardness of the slurry, product yield may be improved.

Although the rinse member 350 includes two rinse nozzles 351 and 352 in this embodiment, the number of the rinse nozzles 351 and 352 may increase or decrease according to process efficiency and an injection amount of the rinse nozzles 351 and 352.

The rinse member 350 is fixed to a side of the fluid supply part 320 by a fixing bracket 360. That is, a top surface of the fixing bracket 360 is fixedly coupled to the swing part 330, and the rinse member 350 is fixedly coupled to a lateral surface of the fixing bracket 360.

Referring again to FIGS. 5 and 9, the pressure applied to the wafer by the polishing unit 300 is regulated by the pad pressure regulating part 900. The pad pressure regulating part 900 may include an air supply 910, a main line 920, a regulator 930, an electro-pneumatic regulator 940, a first valve 950, a manometer 960, a vacuum member 970, a sub-line 980, and a second valve 990.

Specifically, the air supply 910 supplies air to be supplied to the bellows 316 of the compressing part 310 to the main line 920. An input end of the main line 920 is connected to the air supply 910 and an output end thereof is connected to the air injection tube 327. The main line 920 supplies the air injected from the air supply 910 to the air injection tube 327 during the polishing process. Thus, the bellows 316 may be expanded. Also, the main line 920 transmits a vacuum pressure provided from the vacuum member 970 to the air injection tube 327 during the standby state of the polishing unit 300. Thus, the bellows 316 may be contracted.

The regulator 930, the electro-pneumatic regulator 940, the first valve 950, and the monometer 960 are sequentially disposed in the main line 920. The regulator 930 decompresses an air pressure supplied from the air supply 910 to the main line 920 to a predetermined pressure. The air decompressed by the regulator 930 is moved toward the electro-pneumatic regulator 940. The electro-pneumatic regulator 940 automatically regulates the pressure of the air decompressed by the regulator 930 at a preset pressure during the polishing process. The air within the main line 920 is moved toward the first valve via the electro-pneumatic regulator 940. The first valve 950 performs an on/off operation to supply and interrupt the air injected into the main line 920 to/from the air injection tube 327. The monometer 960 is disposed between the first valve 950 and the air injection tube 327 to measure a final pressure of the air supplied to the air injection tube 327.

The pad pressure regulating part 900 regulates the final pressure of the air supplied to the air injection tube 327 to regulate a pressure at which the polishing unit 300 compresses the wafer 70. That is, in the polishing unit 300, the pressure of the air injected into the bellows 316 is regulated according to the final pressure of the air supplied from the pad pressure regulating part 900, and the expansion degree of the bellows 316 is changed according to the internal air pressure. That is, as the pressure of the air injected into the bellows 316 increases, the bellows 316 is further expanded. As a result, the pressure at which the polishing pad 311 compresses the wafer 70 increases. On the other hand, as the pressure of the air injected into the bellows 316 decreases, the bellows 316 is further contracted. As a result, the pressure at which the polishing pad 311 compresses the wafer 70 decreases.

Specifically, the pad pressure regulating part 900 regulates the final air pressure according to a horizontal position of the polishing pad 311 on the wafer 70. That is, the electro-pneumatic regulator 940 is electrically connected to the control unit 60. The control unit 60 controls the electro-pneumatic regulator 940 such that the final air pressure is equal to a reference pressure set corresponding to a corresponding position according to the horizontal position of the polishing pad 311 on the wafer 70. The control unit 60 divides the wafer 70 into a plurality of adjustment sections and sets up a reference pressure suitable for each of the adjustment sections.

As described above, in the pad pressure regulating part 900, the final pressure of the discharged air is regulated by the control unit 60 in each of the adjustment sections of the wafer 70. As a result, the pressure at which the polishing pad 311 compresses the wafer 70 is regulated in each of the adjustment sections. Thus, the polishing unit 300 may prevent a specific region of the wafer 70 from being excessively polished and uniformly polish the wafer 70.

Also, the control unit 60 may be electrically connected the monometer 960. The monometer 960 measures a final air pressure value of the main line 920 to provide the measured final air pressure value to the control unit 60. When the final air pressure is regulated, the control unit 60 controls the final air pressure such that a compression pressure of the polishing pad 311 is equal to the reference pressure, based on a pressure value measured by the monometer 960 and a reference pressure value corresponding to a present point at which the polishing pad 311 is disposed on the wafer 70.

As described above, since the control unit 60 regulates the final air pressure of the main line 920 based on a pressure value measured by the monometer 960, the compression pressure of the polishing unit 300 may be precisely regulated at a pressure equal to the reference pressure of the present adjustment section in which the polishing pad 311 is disposed during the polishing process.

The main line 920 is connected to the sub-line 980. The sub-line 980 is connected to the vacuum member 970 for providing a vacuum pressure. That is, the sub-line 980 is connected to a position between a point at which the monometer 960 is connected and a point at which the first valve 950 is disposed in the main line 920. The sub-line 980 supplies a vacuum pressure supplied from the vacuum member 970 to the fluid supply part 320 through the main line 920. A vacuum pressure supplied from the pad pressure regulating part 900 is supplied to the bellows 316 through the air injection tube 327 and the first to third air flow paths AFP1, AFP2, and AFP3. An internal pressure of the bellows 316 increases by the vacuum pressure supplied from the pad pressure regulating part 900. As a result, the bellows 316 is contracted.

A second valve 990 for controlling whether the vacuum pressure is interrupted and supplied from/to the air injection tube 327 is disposed in the sub-line 980.

A predetermined polishing pattern is formed on a surface of the polishing pad 311 contacting the wafer to improve efficiency of the polishing process. The polishing pattern may be gradually worn by the friction of the wafer when the polishing process is performed on the wafer. Also, the chemical liquids used for the polishing process may be hardened within the polishing pattern. The pad conditioning unit 800 (see FIG. 2) may polish the surface of the polishing pad 311 to recycle the polishing pad 311.

Hereinafter, the pad conditioning unit will be described in detail with reference to accompanying drawings.

Figure 14:
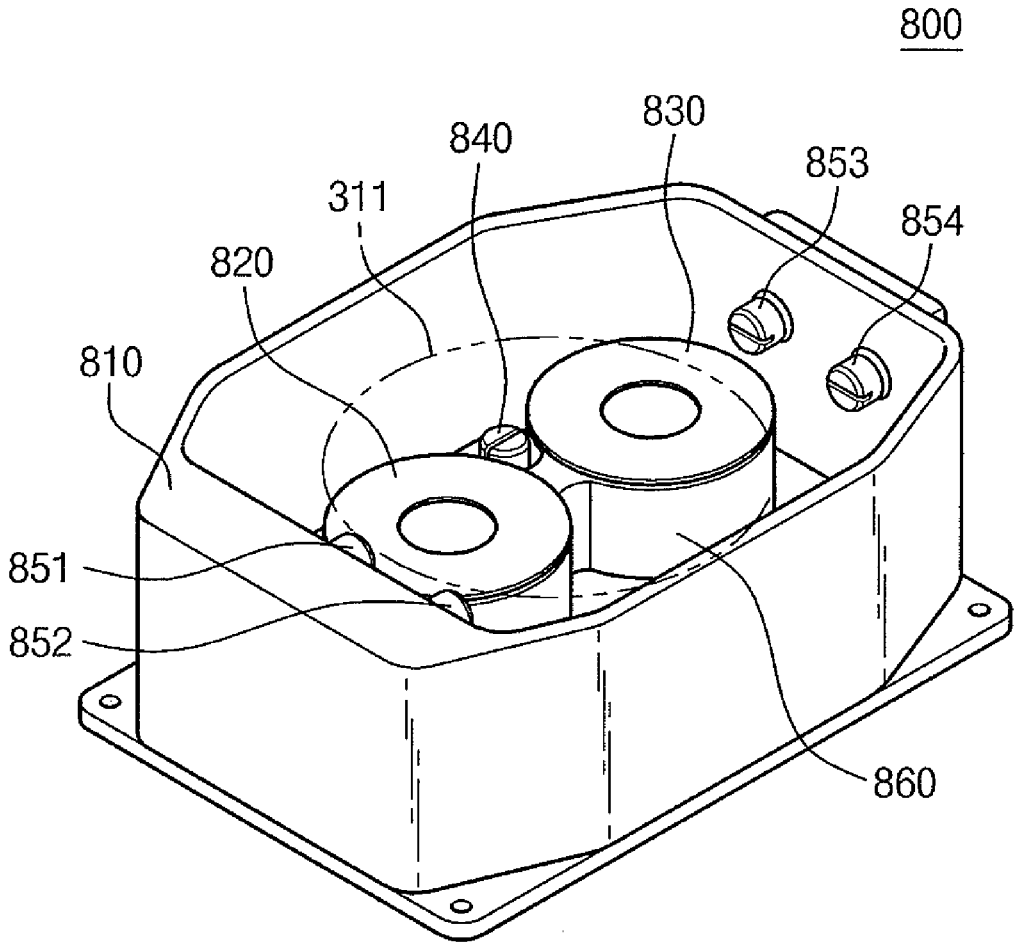
FIG. 14 is a perspective view illustrating a pad conditioning unit of FIG. 3.

FIG. 14 is a perspective view illustrating a pad conditioning unit of FIG. 3.

Referring to FIG. 14, the pad conditioning unit 800 may include a process bath 810, first and second diamond disks 820 and 830, a cleaning nozzle 840, and a plurality of wet nozzles 850.

Specifically, the process bath 810 has a cylindrical shape with an opened upper portion. When the recycling process of the polishing pad 311 is performed, the compressing part 310 (see FIG. 5) of the polishing unit 300 is received into the process bath.

The first and second diamond disks 820 and 830 are disposed inside the process bath 810. The first and second diamond disks 820 and 830 are disposed on a disk supporting part 860 disposed on a bottom surface of the process bath 810. The first and second diamond disks 820 and 830 are horizontally disposed parallel to each other. During the recycling process, the diamond disks 820 and 830 contact the polishing pad 311 to polish the surface of the polishing pad 311.

In an example of the inventive concept, each of the first and second diamond disks 820 and 830 has a circular ring shape and a diameter less that that of the polishing pad 311. Also, each of the first and second diamond disks 820 and 830 may be formed by depositing, attaching, or electrodepositing diamonds on a ceramic material, a metal material, or a resin material.

When the polishing process is completed, the compressing part 310 of the polishing unit 300 is waited in a state where it is received in the process bath 810. The recycling process of the polishing pad 311 is performed when the polishing unit 310 is in a standby state. During the recycling process, the polishing pad 311 is rotated in a state it contacts the first and second diamond disks 820 and 830. Thus, the surface of the polishing pad 311 may be polished by the first and second diamond disks 820 and 830.

Although the pad conditioning unit 800 includes two diamond disks 820 and 830 in this embodiment, the number of the diamond disks 820 and 830 may increase or decrease according to a size of the respective diamond disks 820 and 830 and a size of the polishing pad 311.

The cleaning nozzle 840 is disposed at a side surface of the disk supporting part 840. Also, the cleaning nozzle 840 is disposed adjacent to the first and second diamond disks 820 and 830. When the polishing pad 311 is completely polished by the first and second diamond disks 820 and 830, the cleaning nozzle 840 sprays a cleaning liquid onto the surface of the polishing pad 311 to clean the surface of the polishing pad 311. Specifically, since the polishing pattern is formed on the surface of the polishing pad 311, foreign substances may remain in the polishing pattern. Thus, it may be difficult to remove the foreign substances by their positional condition.

To effectively remove the foreign substances, the cleaning nozzle 840 sprays the cleaning liquid at a high pressure to apply a physical force on the surface of the polishing pad 311. In an example of the inventive concept, the cleaning nozzle 840 may spray the cleaning liquid at a pressure of about 0.01 MPa to about 0.5 MPa. Here, ultrapure water may be used as the cleaning liquid.

The plurality of wet nozzles 851, 852, 853, and 854 is disposed in an inner wall of the process bath 810. Although the pad conditioning unit 800 includes four wet nozzles 851, 852, 853, and 854 in this embodiment, the number of the wet nozzles 851, 852, 853, and 854 may increase or decrease according to the process efficiency.

The wet nozzles 851, 852, 853, and 854 are disposed in two pairs, each pair being disposed in each of two sidewalls facing each other within the process bath 810. Before the polishing pad 311 is polished, the wet nozzles 851, 852, 853, and 854 spray a rinse liquid onto the polishing pad 311 to remove the chemical liquid, e.g., the slurry remaining on the polishing pad 311.

Also, during the recycling process of the polishing pad 311, the wet nozzles 851, 852, 853, and 854 continuously spray the rinse liquid to maintain the inside of the process bath 810 in a wet state. Thus, the pad conditioning unit 300 prevents the slurry remaining on the polishing pad 311 from being hardened during the recycling process of the polishing pad 311.

As described above, the separate pad conditioning unit 800 that is independent of the polishing unit 300 is provided to perform the recycling process of the polishing pad 311 in the standby state. That is, the recycling process of the polishing pad 311 is performed separately from the polishing process of the wafer. Thus, the substrate polishing unit 1000 may prevent diamond pieces remaining on the polishing pad 311 from dropping to the wafer. As a result, the inferior polishing of the wafer may be prevented.

Hereinafter, a process in which the wafer is polished by the substrate polishing unit 1000 will be described in detail with reference to accompanying drawings.

Figure 15:
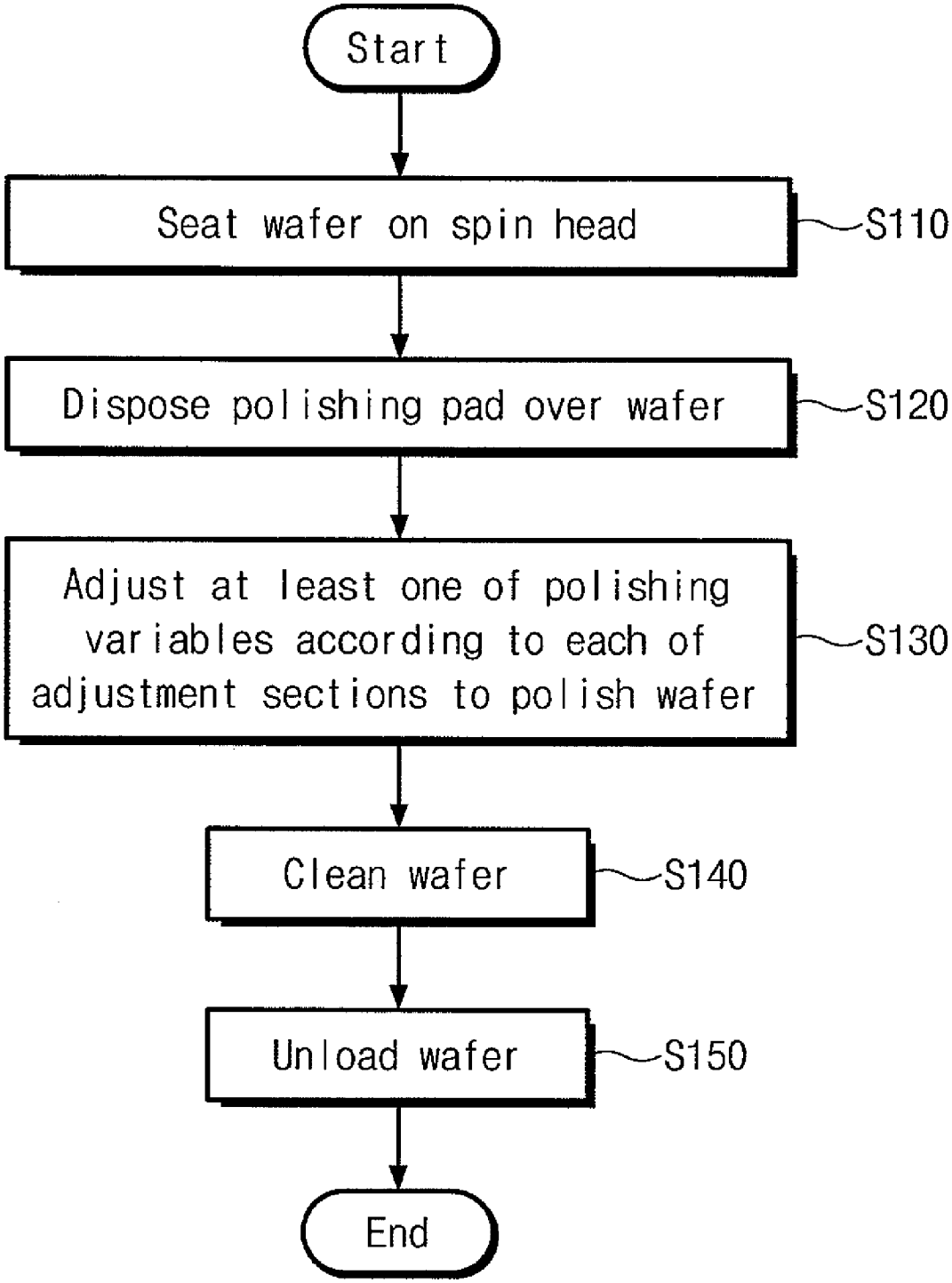
FIG. 15 is a flowchart of a substrate polishing method according to an embodiment of the inventive concept.
Figure 16:
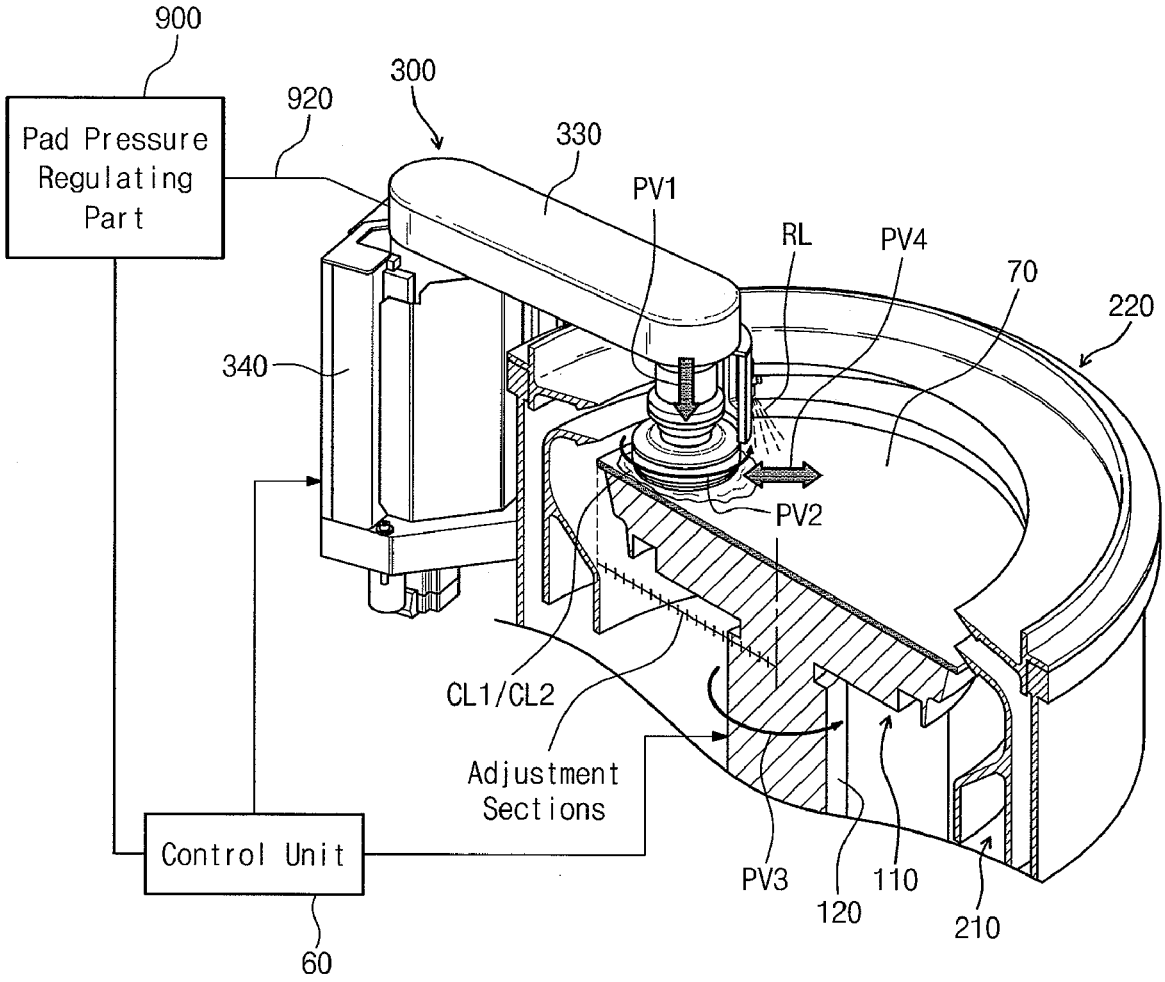
FIG. 16 is a perspective view of an operation state in which a wafer is polished by the polishing unit of FIG. 4.
Figure 17A:
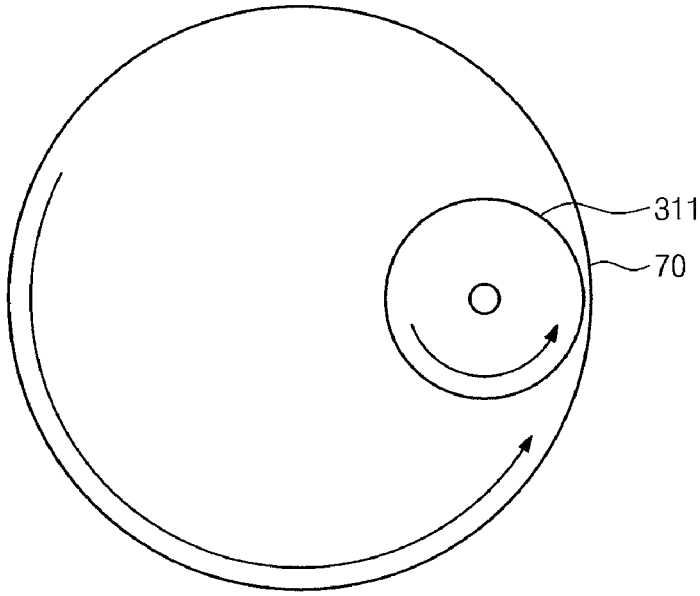
FIGS. 17A and 17B are plan views illustrating an example of a state in which a wafer is polished by a polishing pad of FIG. 16.
Figure 17B:
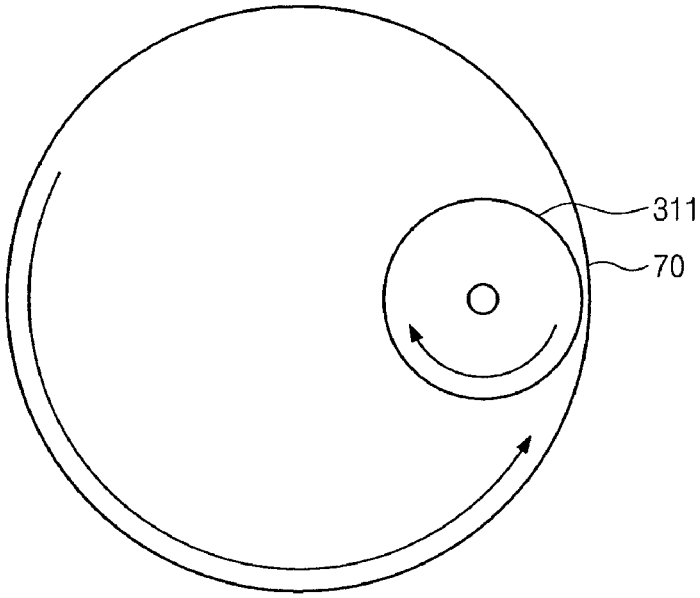

FIG. 15 is a flowchart of a substrate polishing method according to an embodiment of the inventive concept, and FIG. 16 is a perspective view of an operation state in which a wafer is polished by the polishing unit of FIG. 4. FIGS. 17A and 17B are plan views illustrating an example of a state in which a wafer is polished by a polishing pad of FIG. 16.

Referring to FIGS. 3, 15, and 16, in operation S110, the main transfer robot 50 (see FIG. 1) takes out the wafer 70 from the buffer unit 30 to seat the wafer 70 on the spin head 110 of the substrate supporting unit 100, and then, the first and second process bowls 210 and 220 ascend by the ascending/descending unit 260 to seat the spin head 110 inside the first process bowl 210.

In operation S120, the compressing part 310 is disposed above the wafer 70 and adjacent to the wafer 70 by the driving part 340 of the polishing unit 300.

The polishing unit 300 sprays the first and second chemical liquids CL1 and CL2 onto the wafer 70, and simultaneously, rotates the polishing pad 311 of the compressing part 310 about the center axis of the polishing pad 311 in a state where the polishing pad 311 of the compressing part 310 contacts the surface of the wafer 70 to polish the wafer 70. During the polishing process, the first and second chemical liquids CL1 and CL2 are sprayed through the chemical liquid nozzle 318 of the compressing part 310, and the polishing pad 311 are rotated and swung at the same time.

According to this embodiment, in the substrate polishing unit 1000, the polishing unit 300 polishes the wafer 70 while it sprays the first and second chemical liquids CL1 and CL2. However, the polishing unit 300 does not spray the first and second chemical liquids CL1 and CL2, but a separate chemical liquid injection unit, e.g., the first process fluid supply unit 400 (see FIG. 3) or the second process fluid supply unit 500 (see FIG. 3) may spray the first and second chemical liquids CL1 and CL2 for polishing the wafer 70. When the polishing pad 311 polishes the wafer 70, the control unit 60 controls the substrate supporting unit 100, the polishing unit 300, and the pad pressure regulating part 900 to adjust at least one polishing variable of polishing variables PV1, PV2, PV3, and PV4, which may adjust a polishing amount of the wafer 70 for a preset adjustment section VS of the wafer 70. As a result, in operation 5130, the substrate polishing unit 1000 polishes the wafer 70 while it adjusts the polishing amount for the adjustment section VS of the wafer 70.

During the polishing process, the polishing pad 311 may be rotated in the same direction as that of the wafer 70 or in a direction different from that of the wafer 70. For example, as shown in FIG. 17A, the polishing pad 311 and the wafer 70 may be rotated all in the clockwise direction. On the other hand, as shown in FIG. 17B, the polishing pad 311 may be rotated in the counterclockwise direction, and the wafer 70 may be rotated in the clockwise direction.

When the compressing part 310 sprays the chemical liquids CL1 and CL2 while it is rotated to polish the wafer 70, the rinse member 350 may spray the rinse liquid onto the wafer 70. Thus, the polishing unit 300 may prevent the chemical liquids CL1 and CL2 sprayed onto the wafer 70 from being hardened during the polishing process, and also polish and clean the wafer 70 at the same time.

When the polishing process is completely performed by the polishing unit 300, the cleaning process for cleaning the wafer 70 is performed in operation S140.

The cleaning process of the wafer 70 will now be simply described. The top surface of the wafer 70 is physically brushed by the brush unit 600. At this time, the spin head 110 is disposed inside the first process bowl 210. Thereafter, the first and second process bowls 210 and 220 descend by the ascending/descending unit 260 to position the wafer 70 above the first process bowl 210 within the second process bowl 220. Then, the first and second process fluid supply units 400 and 500 spray the process liquid onto the wafer 70 to clean the wafer 70. The aerosol unit 700 sprays the process fluid onto the wafer 70 to remove the foreign substances remaining on the wafer 70.

The wafer 70 is rinsed and dried. The rinse liquid for rinsing the wafer 70 and a drying fluid may be sprayed from one of the first and second process fluid supply units 400 and 500.

As described above, since the polishing process and the cleaning process are sequentially performed within one bowl unit 200 in the substrate polishing unit 1000, the transfer time and process time of the wafer 70 may be reduced to improve the productivity.

Also, in the substrate polishing unit 1000, the polishing process and brush process of the wafer 70 are performed within a process bowl different from that for the cleaning process of the wafer 70. Thus, in the substrate polishing unit 1000, the process liquid used for the polishing process may be separated from the process liquid used for the cleaning process, and thus, recovered separately from each other.

When the cleaning process is completed, the main transfer robot 50 (see FIG. 1) unloads the wafer 70 disposed on the spin head 110 to load the unloaded wafer 70 to the buffer unit 30 (see FIG. 1) in operation S150. The index robot 20 (see FIG. 1) takes out the wafer 70 in which the processes are completed in the substrate polishing unit 1000 from the buffer unit 30 to load the wafer 70 on the FOUPs 12*a*, 12*b*, 12*c*, and 12*d* seated on the loading/unloading unit 10 (see FIG. 1). The wafers in which the polishing process and the cleaning process are completed are transferred to the outside by a unit of the FOUPs 12*a*, 12*b*, 12*c*, and 12*d*.

Hereinafter, a process in which the polishing variables are adjusted according to the adjustment section to polish the wafer will be described in detail.

The polishing variables PV1, PV2, PV3, and PV4 include first to fourth polishing variables PV1, PV2, PV3, and PV4. The first polishing variable PV1 represents a pressure at which the polishing pad 311 compresses the wafer. The second polishing variable PV2 represents a rotation speed at which the polishing pad 311 is rotated about the center axis. The third polishing variable PV3 represents a rotation speed of the spin head 110. The fourth polishing variable PV4 represents a swing speed of the swing part 330.

The polishing amount of the wafer 70 may be changed according to a value of each of the polishing variables PV1, PV2, PV3, and PV4. Also, the polishing amount of the wafer 70 may be changed by adjusting only one of the polishing variables PV1, PV2, PV3, and PV4.

The control unit 60 divides a radius of the wafer into the plurality of preset adjustment sections. In this embodiment, the adjustment sections may have the same distance or distances different from each other.

During to the polishing process, the control unit 60 selects at least one polishing variable for adjusting its value according to each of the adjustment sections among the polishing variables PV1, PV2, PV3, and PV4 to adjust the polishing amount of the wafer 70. The selected polishing variable is set to proper reference values for each of the adjustment sections to uniformly polish the wafer 70. Thus, the reference values of the selected polishing variable may be changed according to the corresponding adjustment sections.

During the polishing process, the control unit 60 controls a value of the corresponding polishing variable such that the value of the selected polishing variable is equal to the reference value corresponding to the present adjustment section in which the polishing pad 311 is disposed. Thus, since the substrate polishing unit 1000 adjusts a value of a specific polishing variable according to the adjustment sections of the wafer 70, the polishing amount of the wafer 70 may be logically adjusted.

Hereinafter, a relationship between the respective polishing variables PV1, PV2, PV3, and PV4 and the polishing amount of the wafer 70 will be described in detail.

Referring to FIGS. 9 and 16, the first polishing variable PV1 represents a pressure value at which the polishing pad 311 compresses the wafer 70. A value of the first polishing variable PV1 is adjusted according to an internal pressure of the bellows 316 disposed in the compressing part 310. The internal pressure of the bellows 316 is adjusted according to a final air pressure of the pad pressure regulating part 900. That is, as a pressure of air discharged from the pad pressure regulating part 900 increases, a pressure within the bellows 316 increases. Thus, the value of the first polishing variable PV1, i.e., the pressure at which the polishing pad 311 compresses the wafer 70 increases. When the compressing pressure PV1 of the polishing pad 311 increases, the polishing amount of the wafer 70 increases.

The control unit 60 controls the electro-pneumatic regulator 940 (see FIG. 5) of the pad pressure regulating part 900 such to the value of the first polishing variable PV1 is equal to the reference value corresponding to the present adjustment section in which the polishing pad 311 is disposed. Thus, the final air pressure of the pad pressure regulating part 900 is regulated according to each of the adjustment sections. As a result, the compressing pressure PV1 of the polishing pad 311 is regulated. When the final air pressure of the pad pressure regulating part 900 is regulated, the control unit 60 determines an adjustment degree of the final air pressure based on the present final air pressure of the pad pressure regulating part 900 measured by the monometer 960 (see FIG. 5) of the pad pressure regulating part 900.

Figure 18:
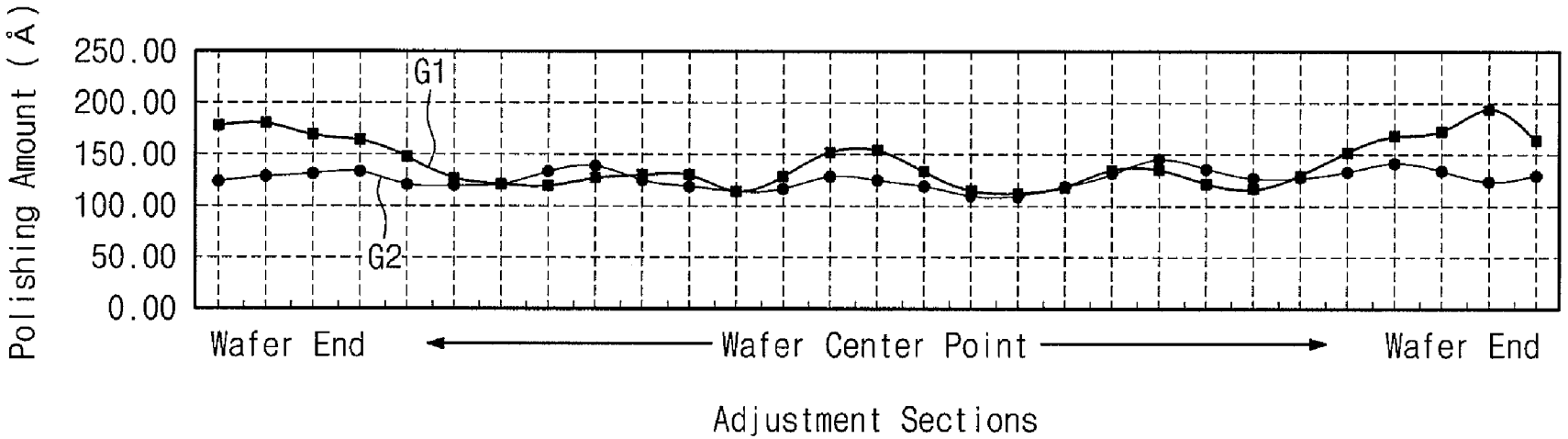
FIG. 18 is a graph illustrating polishing uniformity of a wafer according to a pressure at which the wafer is compressed by a polishing unit.

FIG. 18 is a graph illustrating polishing uniformity of a wafer according to a pressure at which the wafer is compressed by a polishing unit.

Referring to FIGS. 16 and 18, a first graph G1 represents a graph of a polishing amount of the wafer 70 in each of the adjustment sections when the polishing pad 311 polishes the wafer 70 at a predetermined compressing pressure. A second graph G2 represents a graph of a polishing amount of the wafer 70 in each of the adjustment sections when the polishing pad 311 polishes the wafer 70 at a preset compressing pressure in each of the adjustment sections.

Comparing the first graph G1 to the second graph G2, the polishing amount may be uniformly distributed in a case G2 where the compressing pressure is regulated according to each of the adjustment sections when compared to a case G1 in which the polishing pad 311 polishes the wafer 70 while the polishing pad 311 compresses an entire region of the wafer 70 at the same pressure.

That is, when the substrate polishing unit 1000 regulates the compressing pressure for each of the adjustment sections, the polishing uniformity is improved. As a result, substrate polishing unit 1000 may improve product yield and polishing efficiency. In addition, the wafer 70 may be variously polished as necessary.

The control unit 60 may adjust the polishing amount for each of the adjustment sections using the second polishing variable PV2. The second polishing variable PV2 represents a speed at which the polishing pad 311 is rotated about the magnetic center axis, i.e., a spin speed of the polishing pad 311. As the spin speed PV2 of the polishing pad 311 increases, the polishing amount increases. The spin speed PV2 of the polishing pad 311 is adjusted by the second driving motor 342 of the polishing unit 300. The control unit 60 controls the rotation speed of the second driving motor 342 to adjust the spin speed PV2 of the polishing pad 311 according to each of the adjustment sections.

The third polishing variable PV3 represents a rotation speed of the wafer 70, i.e., a rotation speed of the spin head 110. As the rotation speed PV3 of the spin head 110 increases, the polishing amount increases. The rotation speed PV3 of the spin head 110 is adjusted by the supporting part 120 supporting the spin head 110. The control unit 60 controls the rotation speed of the supporting part 120 to adjust the rotation speed PV3 of the spin head 110 according to each of the adjustment sections.

The fourth polishing variable PV4 represents a speed at which the polishing pad 311 is swung on the wafer 70. As the swing speed PV4 of the polishing pad 311 increases, the polishing amount increases. The swing speed PV4 of the polishing pad 311 is adjusted by a speed at which the swing part 330 of the polishing unit 300 is swung. The swing speed of the swing part 330 is adjusted by the first driving motor 341 (see FIG. 6) of the polishing unit 300. The control unit 60 controls the rotation speed of the first driving motor 341 to adjust the swing speed PV4 of the polishing pad 311 according to each of the adjustment sections.

In an example of the inventive concept, the polishing pad 311 is swung between an end and a center point of the wafer 70.

In this embodiment, the control unit 60 adjusts only one of the first to fourth polishing variables PV1, PV2, PV3, and PV4 to adjust the polishing amount for each of the adjustment sections. However, the control unit 60 may combines at least two polishing variables of the first to fourth polishing variables PV1, PV2, PV3, and PV4 to adjust the polishing amount for each of the adjustment sections. Thus, the values of the corresponding polishing variables may be adjusted according to each of the adjustment sections.

According to the above-described inventive concept, the substrate polishing apparatus may locally adjust the polishing amount to improve the polishing uniformity and the product yield.

The above-disclosed subject matter is to be considered illustrative and not restrictive, and the appended claims are intended to cover all such modifications, enhancements, and other embodiments, which fall within the true spirit and scope of the inventive concept. Thus, to the maximum extent allowed by law, the scope of the inventive concept is to be determined by the broadest permissible interpretation of the following claims and their equivalents, and shall not be restricted or limited by the foregoing detailed description.

What is claimed is:

1. A substrate polishing apparatus comprising:

a rotatable substrate supporting member on which a substrate is seated;

a rotatable and swingable polishing unit configured to polish a top surface of the substrate seated on the substrate supporting member; the polishing unit including:

a compressing part having a polishing pad and a bellows disposed above the polishing pad, wherein the compressing part is rotated about a center axis to polish the substrate and the bellows is configured to regulate a pressure at which the polishing pad compresses the substrate using air pressure;

a swing arm connected to the compressing part configured to swing the compressing part; and a driving part disposed below the swing arm and configured to provide a rotation force to the compressing part to swing the swing arm; and a control unit configured for controlling the substrate supporting member and the polishing unit during a polishing process to adjust a value of a polishing variable for adjusting a polishing amount of the substrate according to a horizontal position of the polishing pad with respect to the substrate, the control unit being configured to control the driving part to adjust a rotation speed and a swing speed of the polishing pad and regulate the air pressure injected into the bellows to regulate a compressing pressure of the polishing pad, wherein the control unit is configured to divide the top surface of the substrate into a plurality of adjustment sections and adjust the polishing variable according to each of the adjustment sections during the polishing process.

2. The substrate polishing apparatus of claim 1, wherein the polishing variable comprises one of a pressure at which the polishing pad compresses the substrate, a rotation speed of the polishing pad, a swing speed of the polishing pad, and a rotation speed of the substrate supporting member, or combinations thereof.

3. The substrate polishing apparatus of claim 1, wherein the substrate has a circular plate shape.

4. The substrate polishing apparatus of claim 1, wherein the compressing part further comprises a chemical liquid nozzle disposed above the polishing pad, the chemical liquid nozzle configured to spray a chemical liquid onto the substrate seated on the substrate supporting member, and the polishing unit further comprises a fluid supply part disposed above the compressing part and providing the polishing chemical liquid to the chemical liquid nozzle, the fluid supply part being coupled to a lower portion of the swing part and swung by the swing part.

5. The substrate polishing apparatus of claim 4, wherein a pad hole through which the chemical liquid nozzle is exposed is defined in the polishing pad.

6. The substrate polishing apparatus of claim 5, wherein the fluid supply part comprises:

a rotation shaft connected to the compressing part to rotate the polishing pad, the rotation shaft having a tube shape; and at least one chemical liquid supply tube disposed inside the rotation shaft, the chemical liquid supply tube being fixed when the rotation shaft is rotated and coupled to the chemical liquid nozzle to provide the polishing chemical liquid to the chemical liquid nozzle.

7. The substrate polishing apparatus of claim 6, wherein the compressing part further comprises an O-ring disposed between the pad hole and the chemical liquid nozzle, the O-ring surrounding the chemical liquid nozzle to prevent the polishing chemical liquid sprayed from the chemical liquid nozzle from being introduced into the compressing part.

8. The substrate polishing apparatus of claim 6, wherein the fluid supply part further comprises:

a housing built in the rotation shaft, having a tube shape, connected to the compressing part, and including a first air flow path through which air is introduced;

an air injection tube coupled to the housing to communicate with the first air flow path, the air injection tube receiving air from the outside to provide the air to the first air flow path; and first and second lip seal members disposed between the housing and the rotation shaft, each surrounding the rotation shaft, facing each other in a vertical direction, spaced from each other to define a second air flow path communicating with the first air flow path, wherein a third air flow path communicating with the second air flow path is disposed in the rotation shaft, and air flowing into the third air flow path is injected into the bellows.

9. A method of polishing a substrate, the method comprising:

seating the substrate on a substrate supporting member;

disposing a polishing pad on a top surface of the substrate;

rotating and swinging a polishing unit for polishing the top surface of the substrate seated on the substrate supporting member; the polishing unit including:

a compressing part including the polishing pad and a bellows disposed above the polishing pad, wherein the compressing part is rotated about a center axis to polish the substrate and the bellows is configured to regulate a pressure at which the polishing pad compresses the substrate using air pressure;

a swing arm connected to the compressing part configured to swing the compressing part; and a driving part disposed below the swing arm and configured to provide a rotation force to the compressing part to swing the swing arm;

compressing part including the polishing pad about a center axis;

controlling the driving part to adjust a rotation speed and a swing speed of the polishing pad;

regulating the air pressure injected into the bellows to regulate a compressing pressure of the polishing pad;

controlling the substrate supporting member and polishing unit to adjust a value of a polishing variable; and dividing the top surface of the substrate into a plurality of adjustment sections and adjusting the polishing variable according to each of the adjustment sections during the polishing process.

10. The method of claim 9, wherein the polishing variable comprises one of a pressure at which the polishing pad compresses the substrate, a rotation speed of the polishing pad, a swing speed of the polishing pad, and a rotation speed of the substrate supporting member or combinations thereof.

11. The method of claim 10, wherein the adjusting of the polishing amount of the substrate comprises adjusting the polishing amount of the substrate such that the value of the polishing variable is equal to a reference value of the polishing variable, which is preset corresponding to a present position at which the polishing pad is disposed on the substrate.

12. The substrate polishing apparatus of claim 1, wherein the plurality of adjustment sections is divided along a radius of the substrate.

13. The method of claim 9, wherein the substrate has a circular plate shape.

14. The method of claim 9, wherein the plurality of adjustment sections is divided along a radius of the substrate.

* * * * *